US005995797A

United States Patent [19]

Shigeta et al.

[11] Patent Number: 5,995,797

[45] Date of Patent: Nov. 30, 1999

[54] IMAGE FORMING APPARATUS WHICH CONVEYS UNFIXED TONER IMAGES TO A FIXING DEVICE IN AN UNDISTURBED AND STABLE MANNER SO THAT IMAGES MAY BE FORMED ON BOTH SIDES OF A SHEET

[75] Inventors: Kunio Shigeta; Yotaro Sato; Hisayoshi Nagase; Satoshi Haneda, all of Hachioji; Toshihide Miura, Koganei, all of Japan

[73] Assignee: Konica Corporation, Tokyo, Japan

[21] Appl. No.: 09/081,513

[22] Filed: May 20, 1998

[30] Foreign Application Priority Data

| | | | |
|---|---|---|---|
| May 26, 1997 | [JP] | Japan | 9-135220 |
| Jun. 23, 1997 | [JP] | Japan | 9-165754 |
| Aug. 28, 1997 | [JP] | Japan | 9-232695 |

[51] Int. Cl.[6] ..... G03G 15/20

[52] U.S. Cl. ..... 399/322; 399/397; 399/400

[58] Field of Search ..... 399/322, 320, 399/297, 299, 302, 303, 308, 309, 400, 401, 122, 306, 307, 397; 430/126

[56] References Cited

U.S. PATENT DOCUMENTS

| | | | |
|---|---|---|---|
| 4,941,021 | 7/1990 | Uchida et al. | 399/322 |
| 5,422,710 | 6/1995 | Shirasaka et al. | 399/322 |
| 5,752,130 | 5/1998 | Tanaka et al. | 399/308 X |
| 5,826,143 | 10/1998 | Haneda et al. | 399/309 X |

*Primary Examiner*—Arthur T. Grimley
*Assistant Examiner*—Hoan Tran
*Attorney, Agent, or Firm*—Frishauf, Holtz, Goodman, Langer & Chick, P.C.

[57] ABSTRACT

In an image forming apparatus provided with a first image carrying member; a belt-shaped second image carrying member onto which a toner image is transferred from the first image carrying member; a pair of rotatable fixing members forming a nip region for fixing the toner images transferred on the both sides of the sheet; a conveying device for guiding the sheet separated from an end of the belt-shaped second image carrying member to the pair of rotatable fixing members, when the sheet is nipped and conveyed through the nip region of the pair of rotatable fixing members, the belt-shaped second image carrying member and the pair of rotatable fixing members are arranged such that the sheet is conveyed so as to form a loop protruding from a line connecting the entrance of the nip region and the end of the belt-shaped second image carrying member.

32 Claims, 15 Drawing Sheets

FIG. 3 ( A )
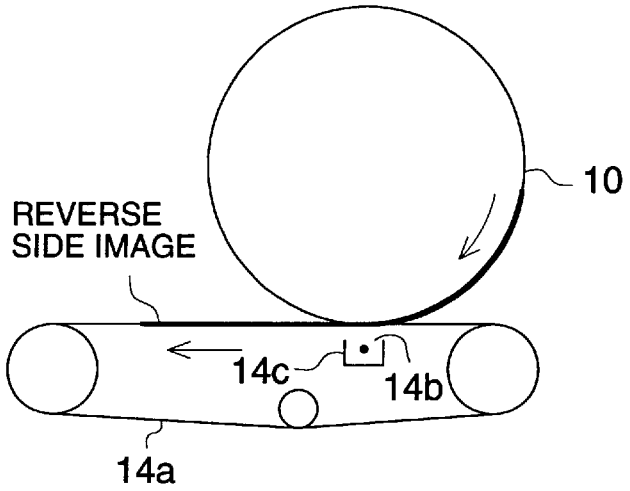
FIG. 3 ( B )
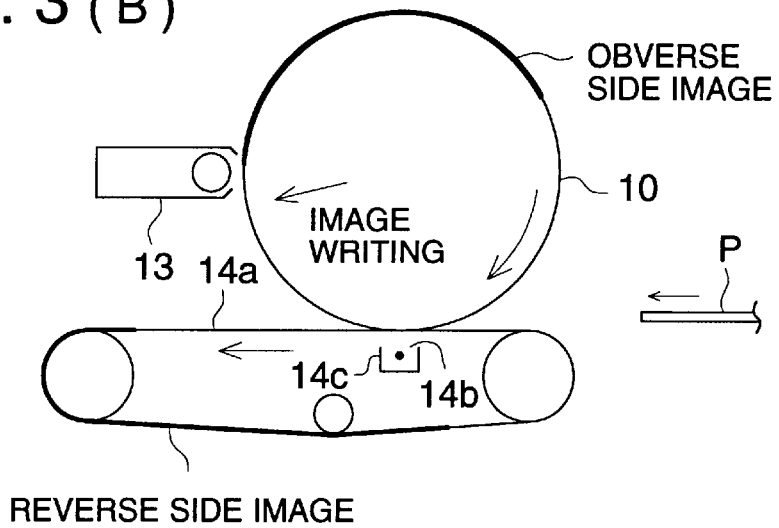
FIG. 3 ( C )
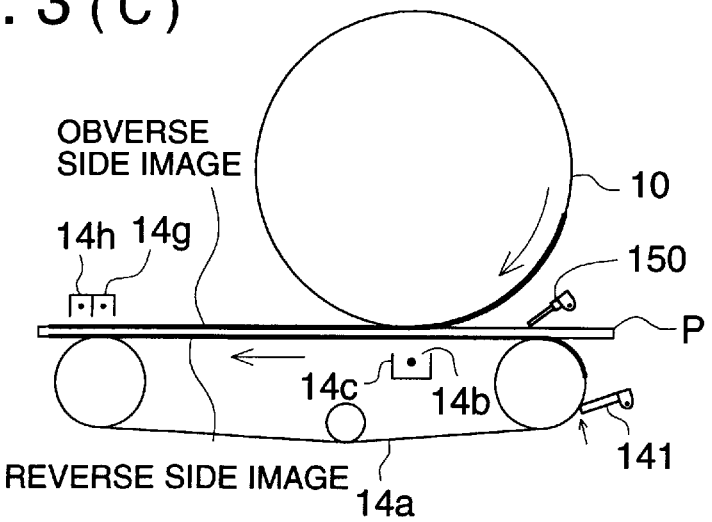

IMAGE FORMING APPARATUS WHICH CONVEYS UNFIXED TONER IMAGES TO A FIXING DEVICE IN AN UNDISTURBED AND STABLE MANNER SO THAT IMAGES MAY BE FORMED ON BOTH SIDES OF A SHEET

BACKGROUND OF THE INVENTION

The present invention relates to an electrophotographic type image forming apparatus such as a copier, printer, facsimile device, or similar device, in which a charging means, an image writing means, and developing means are arranged around an image carrier, and a toner image formed on the image carrier is transferred onto both surfaces of transfer material and fixed.

Conventionally, in two-sided image formation, an image forming method is used in which a one-side image formed on the image carrier is transferred onto a transfer material and fixed; the transfer sheet is temporarily accommodated in a two-sided reversal sheet feeding device; the transfer material is fed from the two-sided reversal sheet feeding device in timed relationship with the image formed again on the image carrier; and the other side image is transferred on the transfer material and fixed.

As described above, in this two-sided image forming apparatus, conveyance of the transfer material such as feeding to the two-sided reversal sheet feeding device, and two times passage through the fixing device, is carried out. Accordingly, reliability of the transfer material conveyance is low, and jamming of the transfer material or shrinkle is sometimes caused. In addition, as is commonly known, conveyance length of the transfer material becomes larger. Therefore, there was a problem that it takes much time for copying.

With respect to this, a method in which fixing is carried out only once after toner images have been formed on two sides of the transfer material, is proposed in Japanese Patent Publication Nos. 37538/1974, 28740/1979, and Japanese Patent Publication Open to Public Inspection Nos. 44457/1989, and 214576/1992.

The inventors of the present invention are investigating an image forming apparatus and an image forming method, in which a plurality of sets of toner image forming means composed of a charging means, image writing means, developing means, etc., are arranged around a photoreceptor drum (the first image carrier means); after superimposed color toner images formed on the photoreceptor drum are temporarily and collectively transferred onto a belt-like toner image receiving body (the second image carrier means) by a first transfer means, superimposed color toner images are formed again on the photoreceptor drum; a transfer material fed in timed relationship with the toner image on the photoreceptor drum and the toner image on the toner image receiving body, is electrically charged by a transfer material charging means, and is attracted to the toner image receiving body; the toner image on the photoreceptor drum is transferred by the first transfer means as an obverse side image, and the toner image on the toner image receiving body is transferred by the second transfer means as a reverse side image, respectively onto two sides of the transfer material conveyed on the toner image receiving body; after that, the transfer material is separated from the toner image receiving body by discharging of a transfer material separation means; the toner images on the transfer material are fixed by a fixing device (fixing means); and a two-sided color image is formed.

As described above, in the above-mentioned image forming apparatus, the number of passage of the transfer sheet on which a toner image is transferred on both sides through the fixing device is allowed to be once. Accordingly, reliability of the transfer material conveyance is high, and conveyance path of the transfer material is shortened, increasing processing speed of image forming.

However, in the above-described image forming apparatus, because the transfer material having unfixed toner images on two sides is conveyed to the fixing device, the toner image receiving body and the fixing device are closely arranged to each other, and the transfer material separated from the toner image receiving body is directly sent to the fixing device. However, when the toner image receiving body is arranged closely to the fixing device, problems occur in which the toner image receiving body is deformed, the toner image transferred onto the toner image receiving body is slightly fused and is hardly transferred, or toner fixedly adheres onto the toner image receiving body. For this reason, the toner image receiving body and the fixing device are arranged with some distance, a conveying section having a spur member (spur) is provided between them, and the transfer material is conveyed from the toner image receiving body to the fixing device by the spur. However, problems occur in which, during transfer material conveyance by the spur, the transfer material is pressed to the direction of the spur, and spur trace occurs on the toner image on the transfer material or the spur is stained by toner, thereby, a toner stain occurs on the transfer material conveyed due to the spur.

The first object of the present invention is to solve the above-described problems, and to provide an image forming apparatus in which generation of a spur trace on a toner image on the transfer material is prevented and toner stain on the transfer material due to stain by spur is prevented.

Further, there is also a problem in which, after the toner images have been transferred onto both sides of the transfer material conveyed by a toner image receiving body, in the case where the transfer material is separated from a toner image receiving body, and the toner images on the transfer material are fixed while the transfer material is being nipped and conveyed by the fixing device, the conveyance speed of the transfer material by the fixing device and that of the transfer material by the toner image receiving body are set to the same speed. However, even if aforesaid conveyance speeds are set to be the same, the transfer material is pulled by a slight speed difference caused between the two conveyance speeds, and unfixed toner images transferred onto two sides of the transfer material are partially disturbed.

The present invention has solved the above problems, and as the result, the second object of the present invention is to provide an image forming apparatus in which, even if a change of speed is generated in the conveyance speed of the transfer material by the second image carrier means or in the conveyance speed of the transfer material by the fixing means, it can be prevented that the transfer material is strongly pulled, and thereby the toner image on the obverse and the reverse side thereof can be transferred and fixed without deteriorating the image quality.

SUMMARY OF THE INVENTION

The above-described first object is attained by the following image forming apparatus.

An apparatus for forming an image, comprising:

a first image carrying member;

toner image forming means for forming toner images on the first image carrying member;

a belt-shaped second image carrying member onto which the toner image is transferred from the first image carrying member;

a first transfer member for transferring the toner image from the first image carrying member to a first side of a sheet;

a second transfer member for transferring the toner image from the second image carrying member to a second side of the sheet;

fixing means for fixing the toner images transferred on the both sides of the sheet, the fixing means forming a nip region between a pair of rotatable fixing members and fixing the toner images onto the sheet by nipping and conveying the sheet through the nip region;

conveying means, provided between the belt-shaped second image carrying member and the fixing means, for guiding the sheet separated from an end of the belt-shaped second image carrying member to the fixing means, wherein when the sheet is nipped and conveyed through the nip region of the fixing means, the belt-shaped second image carrying member and the fixing means are arranged such that the sheet is conveyed so as to form a loop protruding from an extended plane of a sheet conveying plane of the belt-shaped second image carrying member toward the opposite side of the conveying means.

Further, the above-described first object can be attained by the following image forming apparatuses corresponding to the preferable embodiment.

An image forming apparatus having a first image carrier means on which a toner image formed by a toner image forming means is carried; a second image carrier means onto which the toner image carried by the first image carrier means is transferred, and on the surface e of which the transferred toner image is carried; a first transfer means by which the toner image carried by the first image carrier means is transferred onto an obverse side of the transfer material; a second transfer means by which the toner image carried on the second image carrier means is transferred onto a reverse side of the transfer material; and a fixing means in which the transfer material is held and conveyed by a rotating set of fixing members, and by which the toner images transferred onto both sides of the transfer material are fixed, wherein the transfer material is conveyed by the second image carrier means, and after the transfer material is separated from the second image carrier means, the toner images are fixed by the fixing means, the image forming apparatus is characterized in that a conveyance section having a spur to convey the transfer material is provided on the reverse surface side of the transfer material lower than the extended surface of the transfer material conveyance surface of the second image carrier means, between the second image carrier means and the fixing means, and the transfer material is sent to the fixing means through the conveyance section; the transfer material is separated from the belt-like second image carrier means at the end portion on the fixing means side of the second image carrier means, and is moved to the fixing means along the spur of the conveyance section; the transfer material is separated from the spur when the leading edge of the transfer material is nipped by a nip portion formed of a pair of the fixing members of the fixing means; and the transfer material is conveyed through the fixing means under the condition that it is separated from the spur.

An image forming apparatus having a first image carrier means on which a toner image formed by a toner image forming means is carried; a second image carrier means onto which the toner image carried by the first image carrier means is transferred, and on the surface e of which the transferred toner image is carried; a first transfer means by which the toner image carried by the first image carrier means is transferred onto the second image carrier means or an obverse side of the transfer material conveyed by the second image carrier means; a second transfer means by which the toner image carried on the second image carrier means is transferred onto a reverse side of the transfer material; and a fixing means for fixing toner images transferred onto both sides of the transfer material, the image forming apparatus is characterized in that a conveyance section having a plurality of sets of spur members to convey the transfer material is provided between the second image carrier means and the fixing means, and the transfer material is sent to the fixing means through the conveyance section; the transfer material conveyance speed by the fixing means is set to be lower than the transfer material conveyance speed by the second image carrier means; a curvature section which is formed of roller members to stretch the second image carrier means, and by which the transfer material is separated from the second image carrier means, is provided at an end portion on the fixing means side of the second image carrier means; all of the plurality of sets of the spur members are arranged on the reverse surface side of the transfer material, lower than the surface including an entrance of the nip portion of the fixing means and the separation position of the second image carrier means at which the curvature portion of the second image carrier means begins to have the curvature; and the separation position is arranged to be located on the reverse surface side of the transfer material, lower than the tangent at the entrance of the nip portion of the fixing means.

The above-described second object is attained by an image forming apparatus having an image forming body; a means for forming the toner image on the image forming body; an intermediate transfer body which can transfer the toner image on the image forming body and serves as a transfer material conveyance means; a first transfer means for transferring the toner image on the image forming body onto the intermediate transfer body or the obverse side of the transfer material; a second transfer means for transferring the toner image on the intermediate transfer body onto the reverse side of the transfer material; and a fixing means in which the transfer material is nipped and conveyed by rotating paired fixing members and by which the toner image on the transfer material is fixed, the image forming apparatus is characterized in that the conveyance speed of the transfer material by the fixing means is set to be lower than that of the transfer material by the intermediate transfer body.

The above object is attained by an image forming apparatus having a first image carrier means on which a toner image formed by a toner image forming means is carried; a second image carrier means onto which the toner image carried by the first image carrier means is transferred, and on the surface of which the transferred toner image is carried; a first transfer means by which the toner image carried by the first image carrier means is transferred onto an obverse side of the transfer material; a second transfer means by which the toner image carried on the second image carrier means is transferred onto a reverse side of the transfer material, and an image forming apparatus in which the transfer material is conveyed by the second image carrier means and after the transfer material is separated from the second image carrier means, the toner images transferred onto both sides of the transfer material are fixed by the fixing means, the image forming apparatus is characterized in that a conveyance section is provided between the second image carrier means and the fixing means, and the transfer material is sent to the fixing means through the conveyance section; and a spur rotatable by the transfer material and a cleaning member which comes into contact with the leading edge portion of the spur and cleans the spur, are provided in the conveyance section.

BRIEF DESCRIPTION OF THE DRAWINGS

FIGS. 3(A) to 3(C) are views showing a toner image forming condition on both sides of a transfer material by the image forming apparatus according to the present invention.

DETAILED DESCRIPTION OF THE PREFERRED EMBODIMENT

The example of the present invention will be described below. The description of the present column does not limit the technological scope of claims or the meaning of terms, but the following conclusive description shows the best mode of the present invention and does not limit the meaning of terms and technological scope of the present invention. In this connection, in the following description of the example, the surface of one side of the transfer material opposing to the first image carrier means in a transfer area is referred to as the obverse side, the surface of the other side of the transfer material, that is, the surface of the other side of the transfer material opposing to the second image carrier means is referred to as the reverse side, an image transferred onto the obverse side of the transfer material is referred to as an obverse side image, and an image transferred onto the surface of the other side of the transfer material is referred to as a reverse side image.

Figure 1:
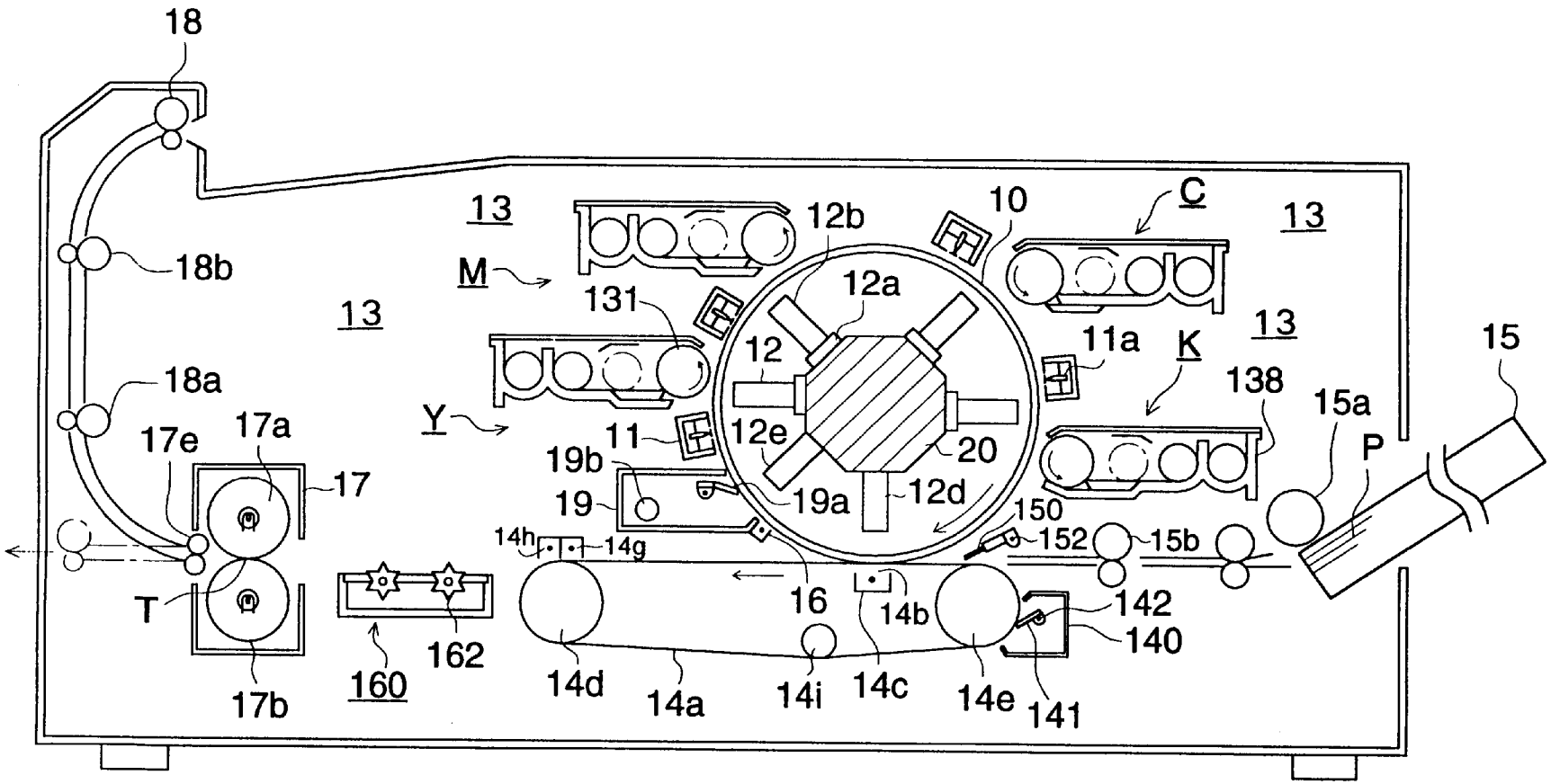
FIG. 1 is a structural sectional view of a color image forming apparatus showing an example of an image forming apparatus according to the present invention.
Figure 2:
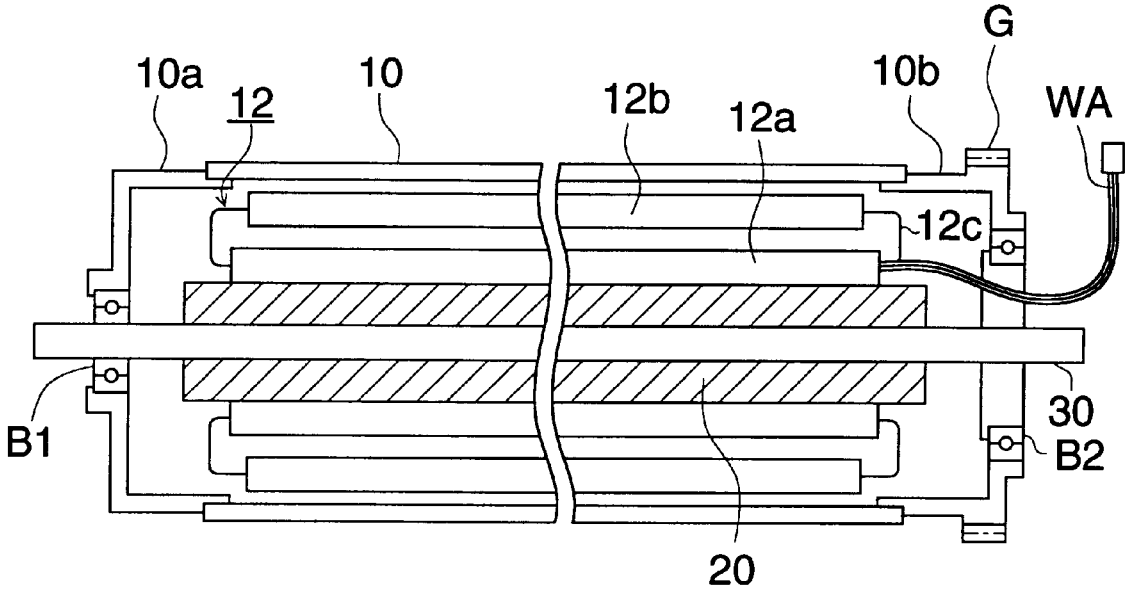
FIG. 2 is a side sectional view of the first image carrier means in FIG. 1.

Referring to FIG. 1 to FIG. 3, an image formation process and each mechanism of an example of an image forming apparatus according to the present invention will be described below. FIG. 1 is a structural sectional view of a color image forming apparatus showing an example of an image forming apparatus according to the present invention. FIG. 2 is a side sectional view of the first image carrier means in FIG. 1. FIGS. 3(A) through (C) are views showing a toner image forming condition when images are formed on both sides of transfer material and feeding of the transfer material. FIG. 3(A) is a view showing the toner image forming condition when the toner image formed on the first image carrier means is transferred onto the second image carrier means for forming the reverse side image. FIG. 3(B) is a view showing toner image forming condition when the obverse side image is formed on the first image carrier means in timed relationship with the reverse side image on the second image carrier means and feeding of the transfer material. FIG. 3(C) is a view showing the two-sided image formation onto the transfer material which is conveyed by the second image carrier means.

In FIG. 1, numeral 10 is a photoreceptor drum which is the first image carrier means, numeral 11 is a scorotron charger which is a charging means for each color, numeral 12 is an exposure optical system which is an image writing means for each color, numeral 13 is a developing device which is a developing means for each color, numeral 14*a* is a toner image receiving body which is the second image carrier means, numeral 14*c* is a transfer device which is the first transfer means, numeral 14*g* is a reverse side transfer device, numeral 150 is a paper charger which is a transfer material charging means, numeral 14*h* is a paper separation AC discharger, numeral 160 is a conveyance section, and numeral 17 is a fixing device which is a fixing means.

The photoreceptor drum 10 serving as the first image carrier means is structured, for example, such that a transparent conductive layer, a photoreceptor layer such as an a-Si layer or an organic photoreceptor layer, or the like, are formed on the outer periphery of a cylindrical base body, formed of a transparent member such as optical glass or transparent acrylic resin, and is rotated clockwise as shown by an arrow in FIG. 1 under the condition that the conductive layer is electrically grounded.

As shown in FIG. 2, the photoreceptor drum 10 uses a drum shaft 30, fixed to the apparatus main body by bearings B1 and B2, inserted into flange members 10*a* and 10*b* of both end portions by which the photoreceptor drum 10 is fixed, as a bearing and is rotatably supported thereby, and is rotated at a constant speed in a predetermined direction when a gear G integrally provided onto the flange member 10*b* is engaged with a driving gear, not shown, provided on the apparatus main body side and driven.

In the present example, a scorotron charger 11 as a charging means for each color, an exposure optical system 12 as an image writing means for each color, and a developing device 13 as a developing means for each color are integrated into one set, and 4 sets are provided for color image formation processes of yellow (Y), magenta (M), cyan (C) and black (K), and are arranged in the order of Y, M, C and K with respect to the rotation direction of the photoreceptor drum 10 as shown by an arrow in FIG. 1.

The scorotron charger 11 as the charging means for each color has a control grid which has a predetermined potential voltage, and a discharging electrode 11*a* composed of, for example, a saw-toothed electrode, and is mounted facing the photoreceptor layer of the photoreceptor drum 10. The scorotron charger 11 conducts a charging action (in the present example, negative charging) by corona discharging with the same polarity of as toner, so that uniform potential voltage is applied on the photoreceptor drum 10. As a discharging electrode 11*a*, a wire electrode or a needle-shaped electrode may also be used other than the above-described electrode.

An exposure optical system 12 as an image writing means for each color is arranged inside the photoreceptor drum 10 such that an exposure position on the photoreceptor drum 10 is on the downstream side in the rotating direction of the photoreceptor drum 10 with respect to the scorotron charger 11 for each color. As shown in FIG. 2, each exposure optical system 12 is an exposure unit composed of a linear exposure element 12*a* in which a plurality of LEDs (light emitting diode) as an light emitting element for image exposure light, arranged in the primary scanning direction in parallel with the drum shaft 30, are aligned array-like, a light conversing light transmission body (trade name: Selfoc lens array) 12*b* as an image formation element, and a lens holder 12*c*, and is attached to a holding member 20. A transfer simultaneous exposure device 12*d* and a uniform exposure device 12*e* are attached to the holding member 20 other than the exposure optical system 12 for each color, and these are integrally accommodated inside the light transmissive base body of the photoreceptor drum 10. The exposure optical system 12 for each color image-exposures the photoreceptor layer of the photoreceptor drum 10 from the rear side according to image data for each color, which has been read by an image reading apparatus separately provided from the apparatus, and stored in a memory, and an electrostatic latent image is formed on the photoreceptor drum 10. As the exposure element 12*a*, an exposure element other than the above element may be used in which a plurality of light emitting elements such as an FL (fluorescent substance light emission), EL (electroluminescence), PL (plasma discharge), etc., are aligned array-like. In this connection, the wavelength of light emission of the image exposure light emitting element is usually used within the of 780–900 nm, within which permeability for Y, M, C toners is high, however, in the present example, because the image exposure is conducted from the rear side, the shorter wavelength of 400–780 nm, which has rather insufficient permeability for color toner, may also be allowable. Incidentally, in FIG. 2, symbol WA is a lead wire from light emitting elements (LEDs) of an image exposure means.

A developing device 13 as a developing means for each color is respectively provided with a developing sleeve 131 which has a predetermined gap with respect to the peripheral surface of the photoreceptor drum 10 and is rotated in the same direction as the rotating direction of the photoreceptor drum 10, and which is formed of, for example, cylindrical non-magnetic stainless steel or aluminum material with 0.5–1 mm thickness and 15–25 mm outer diameter, and a developing casing 138, in which one-component or two-component developer of yellow (Y), magenta (M), cyan (C) and black (K) is respectively accommodated. Each developing device 13 is kept to be in non-contact with the photoreceptor drum 10 with a predetermined interval of, for example, 100–500 $\mu$m by a roller, not shown in the drawing, and by applying developing bias voltage in which DC voltage and AC voltage are superimposed on each other, onto the developing sleeve 131, non-contact reversal development is conducted and a toner image is formed on the photoreceptor drum 10.

A toner image receiving body 14*a* as the second image carrier means is an endless belt with $10^8$–$10^{15}$ $\Omega$·cm volume resistivity, and is a seamless belt of 2 layer construction in which, for example, 5–50 $\mu$m thick fluorine coating, preferably as a toner filming prevention layer, is conducted outside the 0.1–1.0 mm semi-conductive film base body, in which conductive material is dispersed in engineering plastic such as modified polyimide, thermohardening polyimide, ethylene-tetrafluoro ethylene copolymer, polyvinylidene fluoride, nylon alloy, etc. As a belt base body, other than the above base body, 0.1–1.0 mm thick semi-conductive rubber belt, in which conductive material is dispersed in silicon rubber or urethane rubber, may also be used. The toner image receiving body 14*a* is inscribed with a driving roller 14*d*, a driven roller 14*e* and a tension roller 14*i* and stretched around them, and is rotated counterclockwise as shown by an arrow in FIG. 1. The driving roller 14*d* is rotated by a driving motor, not shown in the drawing, thereby the toner image receiving body 14*a* is driven for rotation. When the toner image receiving body 14*a* is rotated, the driven roller 14*e* and the tension roller 14*i* are rotated thereby. The slack of the belt of the toner image receiving body 14*a* during rotation is strained by the tension roller 14*i* which is supported movable due to elastic force by a spring not illustrated.

A transfer device 14*c* as the first transfer means is a corona discharger, provided facing the photoreceptor drum 10 with the toner image receiving body 14*a* between them, and a transfer area 14*b* is formed between the toner image receiving body 14*a* and the photoreceptor drum 10. DC voltage with the reverse polarity to that of toner (positive polarity in the present example) is applied onto the transfer device 14*c*, and a transfer electric field is formed in the transfer area 14*b*, thereby, the toner image on the photoreceptor drum 10 is transferred onto the toner image receiving body 14*a* or the obverse side of recording paper P, which is the transfer material.

A reverse side transfer device 14*g* as the second transfer means, constituted preferably of a corona discharger, is provided facing the electrically grounded conductive driving roller 14*d* with the toner image receiving body 14*a* between them, and DC voltage with the reverse polarity to that of toner (positive polarity in the present example) is applied onto the reverse side transfer device 14*g*, thereby, the toner image on the toner image receiving body 14*a* is transferred onto the reverse side of the transfer material.

A paper charger 150 as a transfer material charging means is provided facing the electrically grounded driven roller 14*e* with the toner image receiving body 14*a* between them, is a conductive brush capable of coming into contact with and not capable of being released from the contact with the toner image receiving body 14*a* by using a support shaft 152 as a rotation fulcrum, thereby it charges recording paper P fed to toner image receiving body 14*a* so as to be attracted to the toner image receiving body 14*a*. As a transfer material charging means, in addition to the above, conductive rollers capable of coming into contact with and not capable of being released from the contact with the toner image receiving body 14*a*, in which DC voltage having the same polarity is impressed, a semi-conductor film member, a blade member or a corona discharger which does not contact with toner image receiving body 14*a* can be used.

A paper separation AC discharger 14*h*, preferably constituted of a corona discharger, as a transfer material separation means is provided at need, being placed by the side of the reverse side transfer device 14*g*, facing the electrically grounded conductive driving roller 14*d* with the toner image receiving body 14*a* between them, at the end portion on the fixing device 17 side of the toner image receiving body 14*a*, and AC voltage on which DC voltage with the same polarity as that of toner or the reverse polarity to that of toner is superimposed, is applied onto the paper separation AC discharger 14*h*, so that the recording paper P conveyed by the toner image receiving body 14*a* is discharged and is separated from toner image receiving body 14*a*.

A conveyance section 160 is provided between the toner image receiving body 14*a* and the fixing device 17, and spurs 162 are provided on the upper surface of the conveyance section 160. The spur 162 takes up the end of recording paper Prepared from toner image receiving body 14*a* due to the curvature of a curvature section provided at the end of fixing device 17 of toner image receiving body 14*a* and discharging effect by paper separation AC discharger 14*h* provided as necessary, and conveys the recording paper P guiding on the reverse side thereof with the toner image on its reverse side to the fixing device 17 while preventing the disturbance of the reverse side toner image.

The fixing device 17 as the fixing means is a heat roller fixing device composed of 2 rollers 17*a* and 17*b* having a heater inside respectively. Aforesaid fixing device 17 provides heat and pressure due to conveying the recording material having toner images on both sides after being separated from toner image receiving body 14*a* by sandwiching it between rollers 17*a* and 17*b* and fixes the toner image on the transfer material by applying heat and pressure onto the toner image between the fixing roller 17*a* and the pressure contact roller 17*b*.

Next, an image forming process will be described.

When image recording starts, the photoreceptor drum 10 is rotated clockwise as shown by an arrow in FIG. 1 by the start of a photoreceptor driving motor, not shown in the drawings, and simultaneously, application of potential voltage is started onto the photoreceptor drum 10 by the charging operation of the scorotron charger 11 of yellow (Y).

After the potential voltage has been applied onto the photoreceptor drum 10, image writing by an electric signal corresponding to the first color signal, that is, Y image data is started by the exposure optical system 12 of Y, and thereby, an electrostatic latent image corresponding to a Y image of the document image is formed on the surface of the photoreceptor drum 10.

The above-described Y latent image formed on photoreceptor drum 10 is non-contact reversal—developed and a yellow (Y) toner image is formed on photoreceptor drum 10.

Next, the potential voltage is applied onto the photoreceptor drum 10 from above the Y toner image by the charging operation of a magenta (M) scorotron charger 11, image writing by the electric signal corresponding to the second color signal, that is, M image data is conducted by an exposure optical system 12 of M, and a magenta (M) toner image is superimposed on the above-described yellow (Y) toner image by the non-contact reversal development by the developing device 13 of M and is formed.

By the same process, a cyan (C) toner image corresponding to the third color signal is further superimposed on the previous toner images and formed by the scorotron charger 11 of cyan (C), exposure optical system 12 of C and developing device 13 of C, and a black (K) toner image corresponding to the fourth color signal is successively superimposed on the cyan toner image and formed by the scorotron charger 11 of black (K), exposure optical system 12 of K, and developing device 13 of K. The super imposed color toner image of 4 colors of yellow (Y), magenta (M), cyan (C), and black (K) is formed on the peripheral surface of the photoreceptor drum 10 during a single rotation of the photoreceptor drum 10 (toner image forming means).

Image writing onto the photoreceptor layer on the photoreceptor drum 10 by these Y, M, C, K exposure optical system 12 is conducted from the inside of the drum through the light transmissive base body. Accordingly, the image writing corresponding to the second, third and fourth color signals is conducted entirely without being influenced by the previously formed toner images, and thereby, the electrostatic latent image with the same quality as that of an image corresponding to the first color signal, can be formed.

The superimposed color toner images as the reverse side image formed on the photoreceptor drum 10, serving as the first image carrier means, by the above-described image forming process, are collectively transferred onto the toner image receiving body 14*a* as the second image carrier means, in the transfer area 14*b*, by the transfer device 14*c*, serving as the first transfer means (FIG. 3 (A)). At that time, uniform exposure may be conducted by the transfer simultaneous exposure device 12*d* provided inside the photoreceptor drum 10 so that good transfer can be conducted.

Toner remaining on the peripheral surface of the photoreceptor drum 10 after transfer, is discharged by a photoreceptor drum AC discharger 16, and after that, moved to a cleaning device 19 as a first image carrier means cleaning means, cleaned by a cleaning blade 19*a* formed of rubber material in contact with the photoreceptor drum 10, and is collected into a waste toner container, not shown, by a screw 19*b*. The peripheral surface of the photoreceptor drum 10 is discharged by exposure by a pre-charging uniform exposure device 12*e* using, for example, light emitting diodes, and hysteresis of photoreceptor drum 10 due to previous image formation is eliminated.

After a superimposed color toner image, which is a reverse side image, has been formed on the toner image receiving body 14*a* due to the forgoing, succeedingly, in the same manner as the above color image forming processes, a superimposed color toner image, which is an obverse side image, is formed on the photoreceptor drum 10 (FIG. 3(B)). In this case, image data is changed so that the obverse side image formed on the photoreceptor drum 10 forms a mirror image with respect to the reverse side image previously formed on the photoreceptor drum 10.

The recording sheet P, serving as the transfer material, is sent from a sheet feed cassette 15, which is a transfer sheet accommodation means, to a timing roller 15*b*, serving as a transfer material feeding means, by a feeding roller 15*a*, and the recording sheet P is in timed relationship with the color toner image of the obverse side image carried on the photoreceptor drum 10, and the color toner image of the reverse side image carried on the toner image receiving body 14*a*, by the drive of the timing roller 15*b*, and recording paper P is sent to the transfer area 14*b*. By a paper charger 150, recording paper P is paper-charged to the same polarity as that of toner, and through a color toner image of the reverse image carried on toner image receiving body 14*a*, aforesaid recording paper P is attracted to the toner image receiving body 14*a* and sent together with the movement of toner image receiving body 14*a*.

In the transfer area 14*b*, the color toner image of obverse side image on the photoreceptor drum 10 is collectively transferred onto the obverse side of the recording sheet P by the transfer device 14*c* as the first transfer means. At that time, the reverse side image carried on the toner image receiving body 14*a* is not transferred onto the recording sheet P, but remains on the toner image receiving body 14*a*. Incidentally, in the case of transfer by the transfer device 14*c*, uniform exposure may be conducted by the transfer simultaneous exposure device 12*d*, which is provided inside the photoreceptor drum 10 and opposite to the transfer area 14*b*, using, for example, light emitting diodes, so that transfer can be finely conducted.

The recording sheet P, onto the obverse side of which the color toner image is transferred, is successively conveyed to a reverse side transfer device 14*g*, serving as the second transfer means, and color toner image on the reverse side carried on the toner image receiving body 14*a* is collectively transferred onto the reverse side of the recording sheet P by the reverse side transfer device 14*g* (FIG. 3(C)).

The recording sheet P, in which color toner image was transferred onto the both surfaces thereof as explained above, is separated from the toner image receiving body 14*a* by the curvature of the driving roller 14*d* to drive the toner image receiving body 14*a*, and by the discharging operation of a paper separation AC discharger 14*h* as a transfer material separation means, which is provided at need on downstream side of reverse surface transfer device 14*g*, and is conveyed to the fixing device 17 as the fixing means, through a conveyance section 160 provide with a spur 162, which will be described later.

In fixing device 17 as the fixing means structured by 2 roller-like fixing members in both of which a heater is housed. The toner image adhered onto the obverse and reverse sides of the recording sheet P is fixed when the heat and pressure are applied onto it at a nip portion formed of a fixing roller 17*a* as a fixing member which is arranged to fix the color toner image of the obverse side image, and a pressure contact roller 17*b* as the fixing member arranged to fix the toner image of the reverse side image (image on the lower surface side). The recording sheet P on which two-sided image recording has been conducted, is reversed through a fixing delivery sheet roller 17*e*, conveyance rollers 18*a*, 18*b*, and delivery sheet roller 18, and is conveyed, and is delivered to the upper portion of the apparatus, with the toner image of the obverse side image facing downward. Further, as shown by a one-dotted chain line in FIG. 1, a switching member, not shown, may be provided at a rear portion of the fixing delivery sheet roller 17*e* of an exit of the fixing device 17 so that the recording sheet P advances straight with the toner image of the obverse side image facing upward, to a tray provided outside the apparatus, and is delivered.

Toner, remaining on the toner image receiving body 14*a* after transferring, is cleaned by a toner image receiving body cleaning device 140 which is provided opposite to the driven roller 14*e* with the toner image receiving body 14*a* between them, and which has a toner image receiving body cleaning blade 141 which can be rotated around a support shaft 142 and can be in contact with and contact-released from the toner image receiving body 14*a*.

The toner remaining on the photoreceptor drum 10 after transferring, is discharged by a photoreceptor drum AC discharger 16, and after that, remaining toner is removed by the cleaning device 19. By the pre-charging uniform exposure device 12*e*, hysteresis of the photoreceptor drum 10 due to previous image formation is eliminated, and the photoreceptor drum 10 enters the next image formation cycle.

By using the above-described method, the superimposed color toner image are collectively transferred, thereby, doubling of the color image, scattering of toner, or frictional damage on the toner image receiving body 14*a* hardly occurs, and therefore, a fine two-sided color image having smaller image deterioration can be formed.

Figure 4:
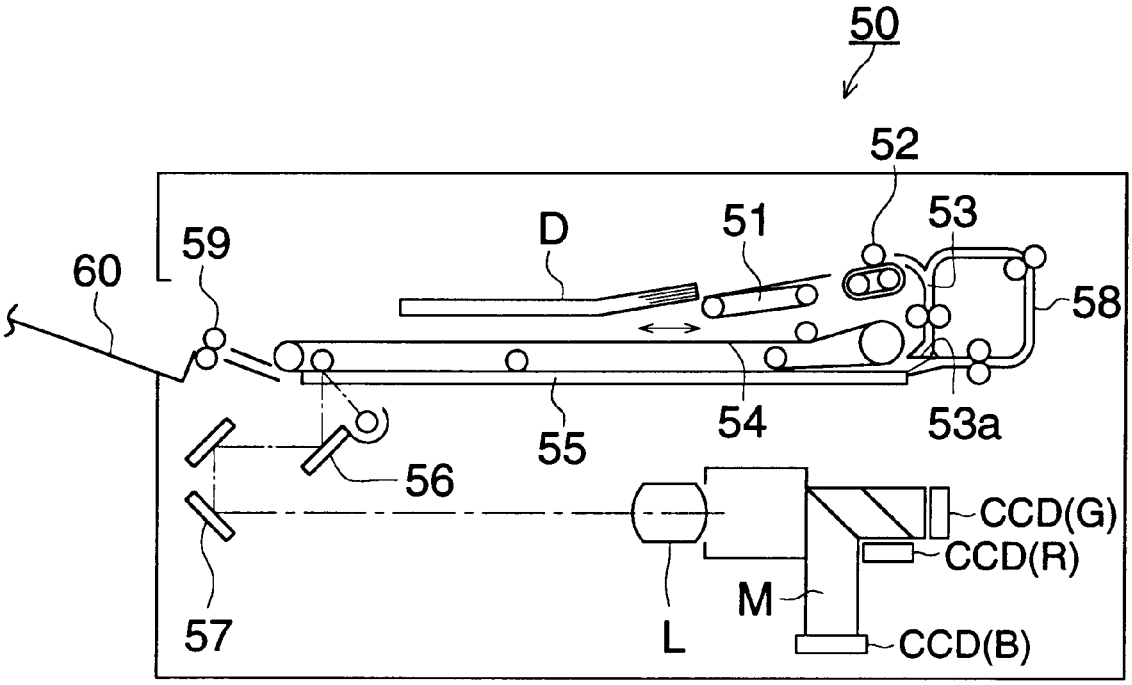
FIG. 4 is a structural sectional view of the image forming apparatus.

Image data for each color of the document inputted into the above-described color image forming apparatus is read by an image reading device 50 provided separately from the apparatus main body or provided in the upper portion of the apparatus main body shown, for example, in FIG. 4.

When the image reading device 50 is used, the document D is stacked in the order of pages from the lower side, with the obverse side facing downward, and the lowermost document D is carried toward a conveyance path 53 by the operation of a carrying belt 51 and a handling roller 52.

The carried-out document D removes a guide plate 53*a*, which is activated at a position shown by a solid line, and withdraws it to a position shown by a dashed line. The document D is fed onto a transparent platen glass 55 through a conveyance belt 54, and is temporarily stopped at a document reading position with the reverse side facing downward.

The reverse side image of the document D on the platen glass 55 is read by the reading operation due to the speed V of the first mirror unit 56 and the moving exposure due to the speed V/2 of the second mirror unit in the same direction, and is formed on 3 image pick-up elements CCDs through a projection lens L and a dichroic prism M, wherein the first mirror unit 56 is composed of an illumination lamp and the first mirror, and the second mirror unit 57 is composed of the second mirror and the third mirror which are arranged V-shape. The reverse side image which has been color-separated and formed on the image pick-up elements CCDs, is stored in an image memory (I) as each color image data after being image-processed, outputted to each exposure optical system 12 as an electric signal, and a latent image is formed on the photoreceptor drum 10. The toner image formed after developing, is transferred by the transfer device 14*c*, and the reverse side image is formed on the toner image receiving body 14*a*.

In the image reading device 50, when reading of the reverse side image has been completed, the obverse side and the reverse side of the document D are reversed through a reversed sheet feeding path 58 by a temporary reverse rotation of a conveyance belt 54, fed again onto the platen glass 55 by the conveyance belt 54 through the conveyance path 53, and is temporarily stopped at the document reading position under the condition that the obverse side faces downward.

The obverse side image of the document D on the platen glass 55 is read by the scanning optical system, temporarily stored in an image memory (II) as each color image data after image processing and outputted to each exposure optical system 12 as an electric signal, and the obverse side image is formed on the photoreceptor drum 10.

The reverse side image formed on the toner image receiving body 14*a* and the obverse side image formed on the photoreceptor drum 10 are respectively transferred onto the obverse side and the reverse side of the first recording sheet P fed from the sheet feed cassette 15, and the copy cycle of the first sheet is completed. The recording sheet P having the obverse side toner image and the reverse side toner image is fixed by the fixing device 17, the obverse side and reverse side of the recording sheet P are reversed, and the recording sheet P is delivered with the obverse side facing downward onto a tray provided outside the apparatus.

In the case of copying the second and subsequent sheet, the document D is not read, the reverse side image is formed by outputting image data from the image memory (I), the obverse side image is formed by outputting image data from the image memory (II), and the obverse side image and the reverse side image are respectively transferred onto the obverse and reverse sides of the second and subsequent recording sheet P fed from the sheet feed cassette 15. The recording sheet P having the obverse side toner image and the reverse side toner image is fixed by the fixing device 17, and is stacked on the previously delivered recording sheets in the order of pages with the obverse side facing downward.

On the other hand, in the image reading device 50, the document D which has been read, is delivered onto the tray 60 by the operation of the conveyance belt 54 through the delivery sheet roller 59 such that the document D is stacked on the tray 60 in the order of pages from the lower side with the obverse side facing downward.

The First Example of the Transfer Sheet Loop Formation

Figure 5:
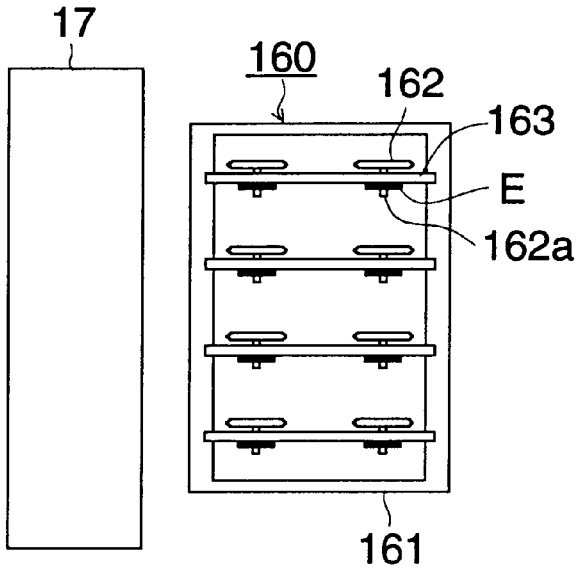
FIG. 5 is a view showing a conveyance section.
Figure 6:
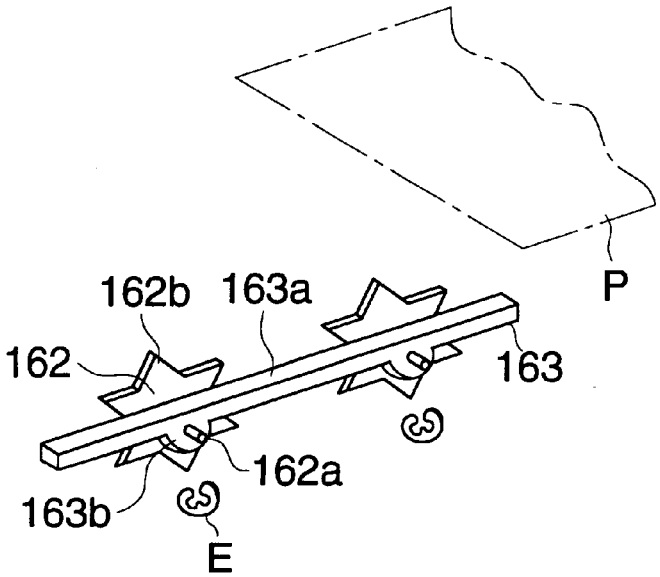
FIG. 6 is a perspective view of a spur provided in the conveyance section.

Referring to FIGS. 5, 6 and 1, a conveyance section having a spur according to the present invention will be described below. FIG. 5 is a view showing the conveyance section, and FIG. 6 is a perspective view of a spur provided in the conveyance section.

A conveyance section 160 provided with a spur 162 on the side lower than the extended surface of the transfer material conveyance surface of the toner image receiving body 14*a*, is provided between the toner image receiving body 14*a* and the fixing device 17, and the recording sheet P separated from the toner image receiving body 14*a* is conveyed through the conveyance section 160 to the fixing device 17 which is vertically provided with the fixing roller 17*a* and the pressure contact roller 17*b*.

A central shaft 162*a* integrally provided in the spur 162 is inserted into a hole of a semi-circular stop portion 163*b* which is provided on the opposite side of the guide surface 163*a* of a conveyance guide member 163, a leading edge portion of the central shaft 162*a* is held by an E-shaped ring E, and the spur 162 is rotatably fitted to the conveyance guide member 163. A plurality of conveyance guide members 163 provide with spurs 162 are fitted to a conveyance section casing 161, and thus, the conveyance section 160 is structured.

The guide surface 163*a* of the conveyance guide member 163 is provided on the transfer material conveyance surface side rather than at the rotation center of the spur 162. Due to this, even when the leading edge portion of the recording sheet p separated from the toner image receiving body 14*a* comes into contact with the guide surface 163*a*, it is taken up and sent to the spur 162, the spur 162 is rotated under the condition that a protruded portion 162*b* of the spur 162 comes into contact with the recording sheet P or sticks into it, and the recording sheet P is conveyed to the fixing device 17 without being rubbed.

The spur 162, formed of a 0.05–0.5 mm thick and 5–25 mm outer diameter metallic plate in which a metallic plate such as a stainless steel plate or a copper plate is etching-processed, or a 0.5–2.0 mm thick and 5–25 mm outer diameter resin member, is used, and is formed of a polygonal member, for example, hexagonal plate-like member, in which a sharp protruded portion 162*b* is provided on the leading edge of the member.

Figure 7:
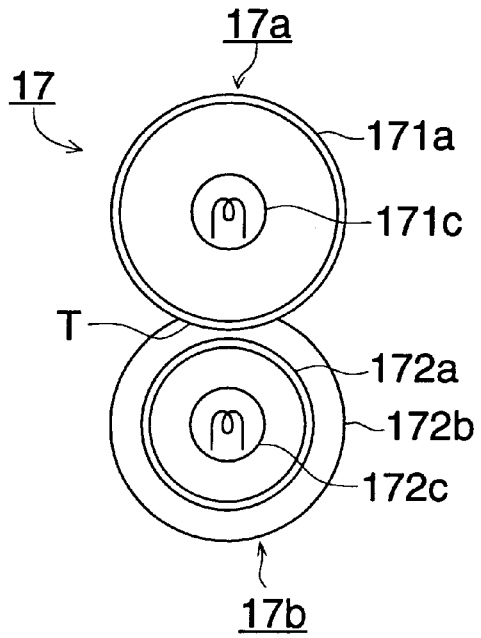
FIG. 7 is a view showing the first example of the roller structure used in a fixing means.
Figure 8:
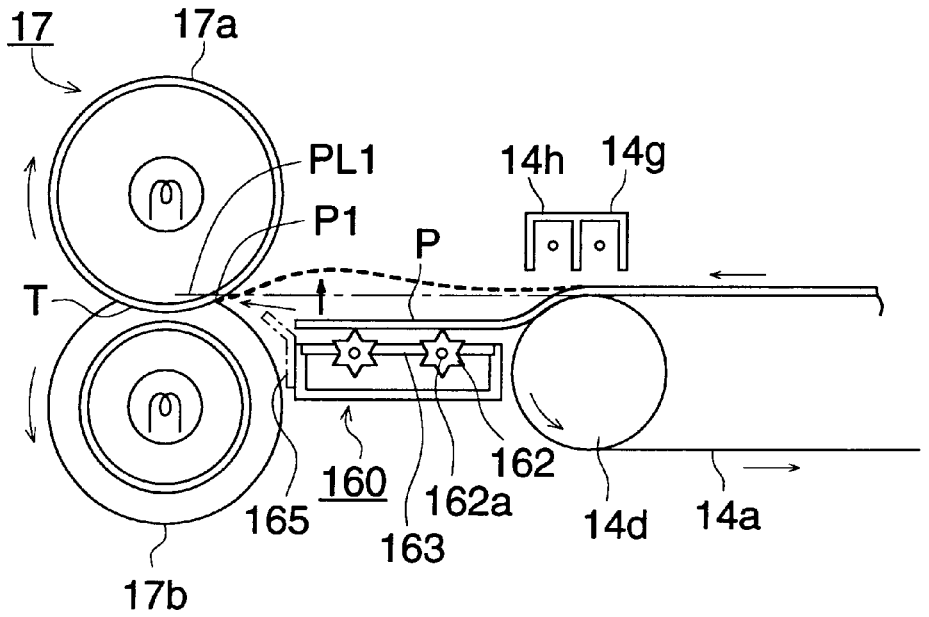
FIG. 8 is a view showing the first example of a method for conveying the transfer material by the roller structure in FIG. 7.

In FIG. 7 and FIG. 8, in the case of two-side image formation in which a large amount of thermal capacity is needed at fixing, the recording sheet P intermittently passes the fixing device, and in the case of only one-side obverse side image formation, the recording sheet P continuously passes the fixing device 17. In any case, the fixing roller 17*a* to fix obverse side image preferably has fine thermal conductivity and large thermal capacity. As shown in FIG. 7, in respective roller members of the fixing device 17, a hard roller using a metallic roller member 171*a* such as steel member or aluminium member, for example, on the surface of which Teflon coating is conducted, is used for the fixing roller 17*a* as the upper roller member; and a soft roller in which, a rubber roller 172*b* using, for example, silicon member is formed around a metallic pipe 172*a* using, for example, aluminium member, and for example, Teflon coating is conducted on the surface, is used for the pressure contact roller 17*b* as the lower roller member. When both rollers are in pressure-contact with each other, a convex circular arc nip portion T is formed on the side of pressure contact roller 17*b* using the soft roller. Halogen heaters 171*c* and 172*c* for a fixing heat are provided inside respective rollers.

As shown in FIG. 8, the recording sheet P on both sides of which the color toner image is formed, is separated from the toner image receiving body 14*a* by the curvature of the driving roller 14*d* to drive the toner image receiving body 14*a*, and by the discharging operation of the paper separation AC discharger 14*h* as the transfer material separation means provided opposite to the driving roller 14*d* at need at the end portion of the toner image receiving body 14*a*.

The recording sheet P separated from the toner image receiving body 14*a* as the second image carrier means, is conveyed by the spur 162 provided lower side of the extended surface of the transfer material conveyance surface PL1 of the toner image receiving body 14*a*, and is sent to the nip portion T of the fixing device 17 as the fixing means composed of the upper and lower rollers in which the hard roller is used as the fixing roller 17*a*, and the soft roller is used as the pressure contact roller 17*b*.

When the leading edge of the recording sheet P as the transfer material is nipped by a circular arc nip portion T of the fixing roller 17*a*, a force acts on the recording sheet P to take up it in the tangential direction of the fixing roller 17*a* at the point P1 on the entry side of the recording sheet P in the nip portion T, a loop is formed so that the reverse side of the recording sheet P is separated from the spur 162 as shown by a bold line arrow in FIG. 8, the recording sheet P is conveyed in the upper portion of the conveyance section 160 under the condition that the recording sheet P is separated from the spur 162, and the recording sheet P is fixed by the fixing device 17. In this case, the extended surface of the transfer material conveyance surface PL1 of the toner image receiving body 14*a* preferably comes into contact with the vicinity of the nip portion T of the fixing roller 17*a* as the upper roller member of the fixing device 17, for example, a 1–3 mm upper portion of the point P1 on the entry side of the recording sheet p in the nip portion T. Thereby, the recording sheet P smoothly advances into the nip portion T.

As described above, because the obverse side image fixing roller is the hard roller, even when the recording sheet or OHT used as the transfer material contacts with the obverse side image fixing roller, the obverse side image fixing roller is not damaged. Further, because the reverse side image fixing roller is the soft roller, the width of nip portion is larger, so that fine fixing can be conducted.

Further, a plate-like entry guide member 165 as shown by a one-dotted chain line in FIG. 8 may be provided between the conveyance section 160 and the fixing device 17, and thereby, the leading edge of the recording sheet P comes into contact with the fixing roller 17*a* as the upper roller member through the entry guide member 165. In this case, when the leading edge portion of the entry guide member 165 is provided lower the point P1 in the nip portion T, it is preferable because the toner image of the reverse side image of the recording sheet P is not rubbed by the leading edge portion of the entry guide member 165.

Due to the foregoing, generation of a spur track on the toner image on the transfer material and toner contamination of a transfer material due to contamination of spur are prevented.

The Second Example of Loop Formation of the Transfer Sheet

Figure 9:
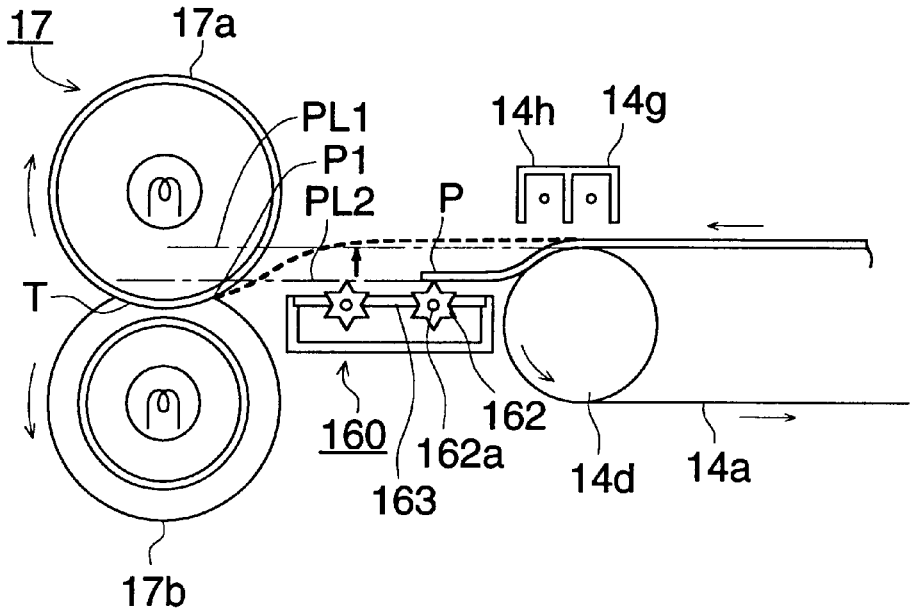
FIG. 9 is a view showing the second example of a method for conveying the transfer material by the roller structure in FIG. 7.

According to FIG. 9, in the present example, the conveyance section 160 described in FIG. 8 is arranged upper than that in FIG. 8, and the construction of rollers of the fixing means is the same as that described in FIG. 6.

The recording sheet P on both sides of which the color toner image is formed, is separated from the toner image receiving body 14*a* by the curvature of the driving roller 14*d* to drive the toner image receiving body 14*a*, and by the discharging operation of the paper separation AC discharger 14*h* as the transfer material separation means provided opposite to the driving roller 14*d* at need at the end portion of the toner image receiving body 14*a*.

The recording sheet P separated from the toner image receiving body 14*a* as the second image carrier means, is conveyed by the spur 162 provided lower side of the extended surface of transfer material conveyance surface PL1 of the toner image receiving body 14*a*, and is sent to the circular arc nip portion T of the fixing device 17 as the fixing means composed of the upper and lower rollers, in which the hard roller is used as the fixing roller 17*a*, and the soft roller is used as the pressure contact roller 17*b*.

When the leading edge of the recording sheet P as the transfer material is nipped by the circular arc nip portion T of the fixing roller 17*a*, a force acts on the recording sheet P to take up it in the tangential direction of the fixing roller 17*a* at the point P1 on the entry side of the recording sheet P in the nip portion T, the reverse side of the recording sheet P is separated from the spur 162 as shown by a bold line arrow in FIG. 9, the recording sheet P is conveyed in the upper portion of the conveyance section 160 under the condition that the recording sheet P is separated from the spur 162, and the recording sheet P is fixed by the fixing device 17.

The extended surface PL2 of the recording sheet P conveyance surface along the spur 162 comes into contact with the vicinity of the nip portion T of the fixing roller 17*a* as the upper roller member of the fixing device 17, for example, a 0.5–2.5 mm upper portion of the point P1 on the entry side of the recording sheet p in the nip portion T. Thereby, the recording sheet P smoothly enters into the nip portion T.

As described above, because the obverse side image fixing roller is the hard roller, even when the recording sheet or OHP used as the transfer material contacts with the obverse side image fixing roller, the obverse side image fixing roller is not damaged. Further, because the reverse side image fixing roller is the soft roller, the width of nip portion is larger, so that fine fixing can be conducted.

Due to the above description, generation of the spur track on the toner image on the transfer material and toner contamination of a transfer material due to contamination of spur are prevented.

The Third Example of Loop Formation of the Transfer Material

Figure 10:
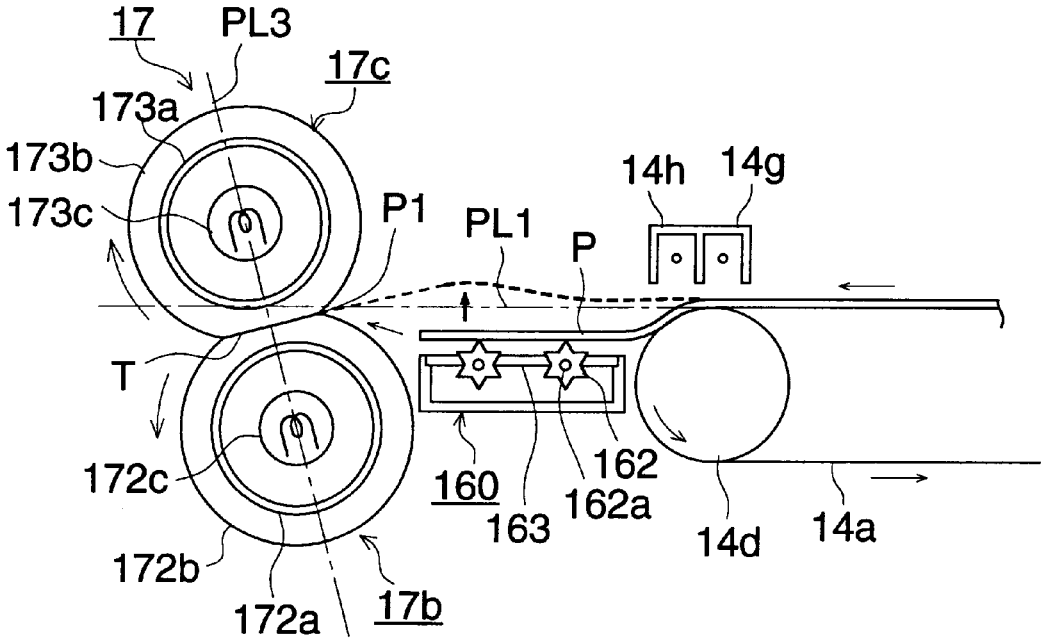
FIG. 10 is a view showing the second example of the roller structure used in the fixing means and a transfer material conveyance method using it.

According to FIG. 10, as the roller members of the fixing device 17 of the present example, a fixing roller 17*c* using the soft roller is used as the upper roller, instead of the upper fixing roller 17*a* using the hard roller described in FIGS. 7 and 8.

As respective roller members of the fixing device 17, a soft roller in which a rubber roller 173*b* using, for example, silicon member is formed around a metallic pipe 173*a* using, for example, aluminum member, is used for the fixing roller 17*c* as the upper roller member and provided with Teflon coat on the surface thereof, and, in the same manner as the upper roller member, a soft roller in which a rubber roller 172*b* using, for example, silicon member is formed around a metallic pipe 172*a* using, for example, aluminum member, and for example, Teflon coating is conducted on the surface, is also used for the pressure contact roller 17*b* as the lower roller member. When both rollers are in pressure-contact with each other, a nip portion T is formed on the upper and lower rollers respectively using the soft roller. Because the upper and lower rollers are composed of soft rollers, the nip portion T is linearly provided almost perpendicular to the surface PL3 passing the central axis of the fixing roller 17*c* and that of the pressure contact roller 17*b*. Halogen heaters 173*c* and 172*c* for a fixing heat are provided inside respective roller members.

Because the nip portion T is formed linearly, the surface PL3 is provided such that the upper roller is inclined toward the delivery side of the recording sheet P with respect to the extended surface of transfer material conveyance surface PL1 of the toner image receiving body 14*a* as the second image carrier means, the fixing roller 17*c* and the pressure contact roller 17*b* are arranged with inclination, and the entrance of the nip portion T is provided above the exit with inclination.

The recording sheet P on both sides of which the color toner image is formed, is separated from the toner image receiving body 14*a* by the curvature of the driving roller 14*d* to drive the toner image receiving body 14*a* as necessary, and by the discharging operation of the paper separation AC discharger 14*h* as the transfer material separation means provided opposite to the driving roller 14*d* at need at the end portion of the toner image receiving body 14*a*.

The recording sheet P separated from the toner image receiving body 14*a* as the second image carrier means, is conveyed by the spur 162 provided lower side of the transfer material conveyance surface PL1 of the toner image receiving body 14*a*, and is sent to the nip portion T of the fixing device 17 as the fixing means composed of the upper and lower rollers, in which the soft rollers are used as the fixing roller 17*a* and the pressure contact roller 17*b*.

When the leading edge of the recording sheet P as the transfer material is nipped by the nip portion T of the fixing device 17, a force acts on the recording sheet P to take up it in the extension direction of the linear nip portion T provided with inclination, the reverse side of the recording sheet P is separated from the spur 162 as shown by a bold line arrow in FIG. 10, the recording sheet P is conveyed above the conveyance section 160 under the condition that the recording sheet P is separated from the spur 162, and the recording sheet P is fixed by the fixing device 17. In this case, the extended surface of the transfer material conveyance surface PL1 of the toner image receiving body 14*a* preferably comes into contact with the vicinity of the nip portion T of the fixing roller 17*c* as the upper roller member of the fixing device 17, for example, a 1–3 mm upper portion of the point P1 on the entry side of the recording sheet P in the nip portion T. Thereby, the recording sheet P smoothly enters into the nip portion T.

Due to the above description, generation of the spur track on the toner image on the transfer material and toner contamination of a transfer material due to contamination of spur are prevented.

The Fourth Example of Loop Formation of the Transfer Sheet

According to FIG. 11, as the roller member of the fixing device of the present example, a thermal fixing film 17*d* serving as a hard roller, which will be described below, is used as the upper roller member, instead of the upper fixing roller 17*a* described in FIGS. 7 and 8.

The thermal fixing film 17*d* as the upper roller member is structured by, for example, a fixing film 174*a* of 40–100 μm thin film, a plate-like heat emitting body (ceramic heater) 174*b*, and a heater holder 174*c* to hold the ceramic heater 174*b*. The seamless type fixing film 174*a* is structured by an inside base member, an intermediate conductive layer and a surface releasing layer. In the same manner as described in FIG. 6, for the pressure contact roller 17*b* as the lower roller member, a soft roller in which a rubber roller 172*b*, for example, using silicon material is formed around a metallic pipe 172*a* using, for example, aluminum material, is used, and a halogen heater 172*c* for fixing heat is provided inside the roller member. When both rollers pressure-contacts with each other, a convex circular arc nip portion T is formed on the side of the pressure contact roller 17*b* using the soft roller.

The base member of the fixing film 174*a* is resistant to high temperature, and under the high temperature, it is rotated while sliding on the ceramic heater 174*b*. As the material in which a change in dimension is small and a high elastic modules is maintained under such the circumstance, polyimide resin is preferably used, and it is preferable that carbon is dispersed so that a 5–20 μm thickness layer is formed on the surface of 20–80 μm thick polyimide resin and the total thickness becomes about 40–100 μm. When the thickness becomes about 40 μm, strength and rigidity is increased, so that deviation during rotation of the fixing film 17*a* can be regulated at the end portion without being buckled. Further, when the thickness is more than 100 μm, the thermal conductivity is lowered, and the thermal capacity is increased, thereby, it is difficult to instantaneously heat the material, and power consumption is also increased. Further, in order to prevent the offset, 2 layer construction in which, for example, a fluorine resin (PFA or PTFE) layer is provided as a releasing layer, is preferable, and further, a conductive layer is provided and electrically grounded so that influence of triboelectric charge generated by sliding between the inner surface of the base material of the fixing film 174*a* and the surface of the ceramic heater 174*b*, is eliminated.

Further, in order to release peeling electrostatic charge of the trailing edge portion of the recording sheet P under the low environment, a conductive filament is inserted into the releasing layer so that the resistance value is decreased, and thereby offset is prevented. However, when the resistance value is too low, because transfer electric charge leaks and offset occurs, the resistance value of $2\times10^{10}$–$5\times10^{11}$ $\Omega/cm^2$ is preferable.

The recording sheet P on both sides of which the color toner image is formed, is separated from the toner image receiving body 14*a* by the curvature of the driving roller 14*d* to drive the toner image receiving body 14*a*, and by the discharging operation of the paper separation AC discharger 14*h* as the transfer material separation means provided opposite to the driving roller 14*d* at the end portion of the toner image receiving body 14*a*.

The recording sheet P separated from the toner image receiving body 14*a* as the second image carrier means, is conveyed by the spur 162 provided lower side of the extended surface of transfer material conveyance surface PL1 of the toner image receiving body 14*a*, and is sent to the nip portion T of the fixing device 17 as the fixing means, composed of the upper and lower rollers, in which the thermal fixing film 17*d* is used as the hard roller serving as the upper roller, and the soft roller is used as the pressure contact roller 17*b*.

Figure 11:
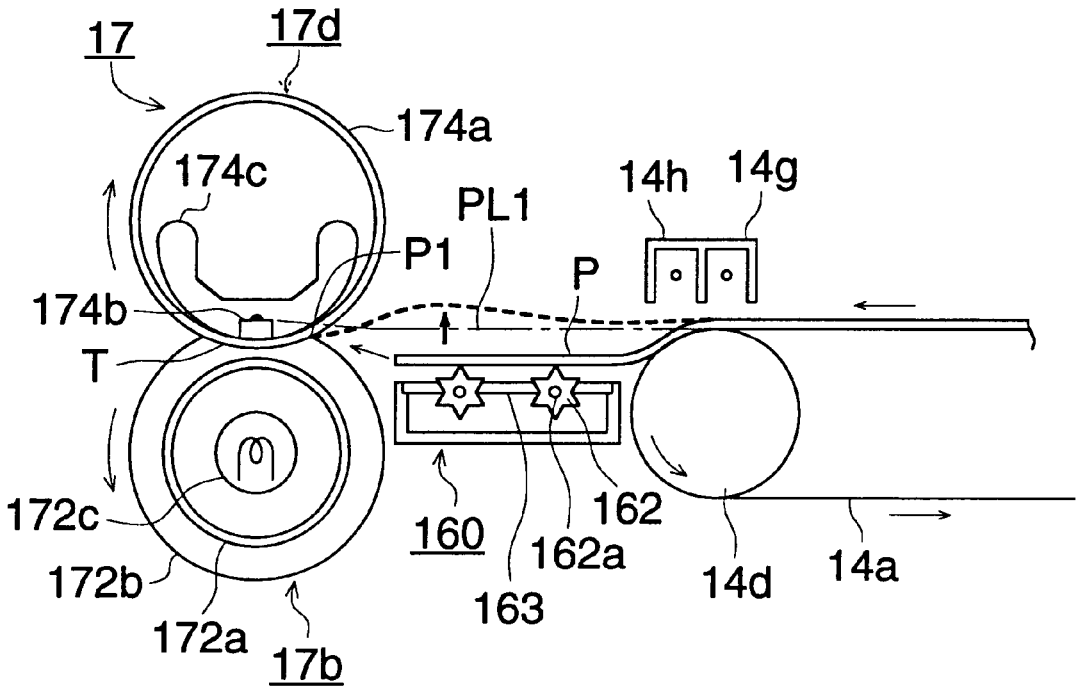
FIG. 11 is a view showing the third example of the roller structure used in the fixing means and a transfer material conveyance method using it.

When the leading edge of the recording sheet P as the transfer material is nipped by a circular arc nip portion T of the fixing device 17, a force acts on the recording sheet P to take up it in the tangential direction of the thermal fixing film 17*d* at the point P1 on the entry side of the recording sheet P in the nip portion T, the reverse side of the recording sheet P is separated from the spur 162 as shown by a bold line arrow in FIG. 11, the recording sheet P is conveyed above the conveyance section 160 under the condition that the recording sheet P is separated from the spur 162, and the recording sheet P is fixed by the fixing device 17. In this case, the extended surface of the transfer material conveyance surface PL1 of the toner image receiving body 14*a* preferably comes into contact with the vicinity of the nip portion T of the thermal fixing film 17*d* as the upper roller member of the fixing device 17, for example, a 1–3 mm upper portion of the point P1 on the entry side of the recording sheet p in the nip portion T. Thereby, the recording sheet P smoothly enters into the nip portion T.

As described above, as a roller for surface image fixing, thermal fixing film which effects as a hard roller is used. Further, because the reverse side image fixing roller is the soft roller, the width of nip portion is larger, so that fine fixing can be conducted.

Due to the above description, generation of the spur track onto the toner image on the transfer material and toner contamination of a transfer material due to contamination of spur are prevented, and image frictional damage by the second image carrier means and transfer slippage by the second transfer means, which are caused when the transfer material is pulled, in the case where the transfer material is nipped by the fixing means, can be prevented.

The Fifth Example of Loop Formation of the Transfer Sheet

Figure 12:
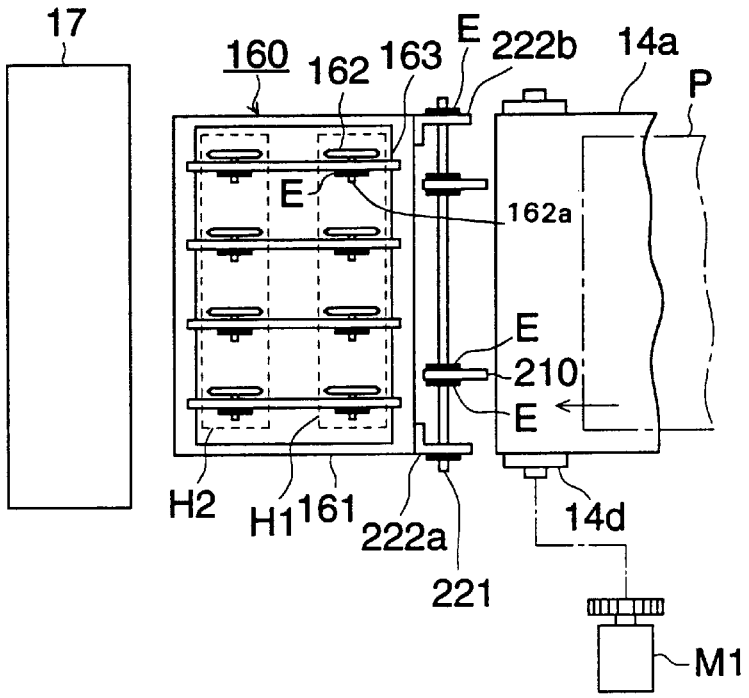
FIG. 12 is a view showing the conveyance section.
Figure 13:
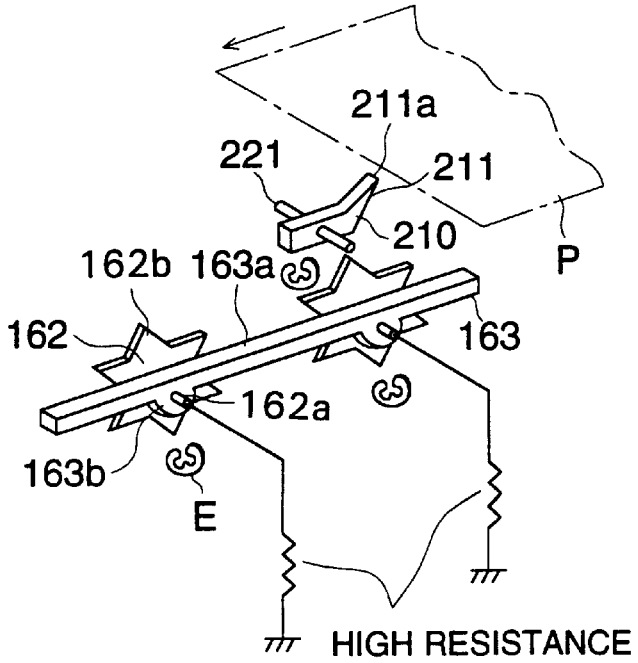
FIG. 13 is a perspective view of a spur member provided in the conveyance section in FIG. 12.

Referring to FIGS. 12, 13 and 1, the spur member and the conveyance section having the spur member will be described below. FIG. 12 is a view showing the conveyance section, and FIG. 13 is a perspective view of the spur member provided in the conveyance section in FIG. 12.

The recording sheet P is conveyed while being attracted by the toner image receiving body 14*a* in which driving roller 14*d*, as a roller member, is driven to be rotated moved by a driving roller 14*d* which is a roller member driven by the driving motor M1, and on the reverse surface side of the recording sheet P lower then the transfer material conveyance surface of the toner image receiving body 14*a* or its extended surface PL1 (hereinafter, it is called the transfer material conveyance surface PL1), the conveyance section 160 provided with the spur 162 which serves as the spur member, is arranged between the toner image receiving body 14*a* and the fixing device 17, and the recording sheet P separated from the toner image receiving body 14*a* is conveyed to the fixing device 17 provided vertically with fixing roller 17*a* and the pressure contact roller 17*b*, through the conveyance section 160.

A plurality of spurs 162 are provided parallelly as spur groups H1, H2, in the direction perpendicular to the conveyance direction of the recording sheet P, that is, in the longitudinal direction of the fixing device 17. Spur groups at least more than 1 group are provided.

The spur 162, formed of a 0.05–0.5 mm thick and 3–25 mm outer diameter metallic plate in which a metallic plate such as a stainless steel plate or a copper plate is etching-processed, or a 0.5–2.0 mm thick and 3–25 mm outer diameter insulating resin member, is used, and is formed of a polygonal member, for example, hexagonal plate-like member, in which a sharp protruded portion 162*b* is provided on the leading edge of the member. In the case where the spur 162 is formed of a metallic plate, it is preferable that the spur 162 is electrically grounded through an electrical resistance of $10^8$–$10^{14}$ Ω. The reason why the spur 162 is electrically grounded through the metallic plate and a high resistance, or using a high resistance member, is that toner or the transfer material has electrical charges, and therefore, electrical charge accumulation on the spur 162 or toner adhesion to the spur by the mirror image force is prevented by discharging so that disturbance of the toner image is prevented. In the same condition, it may also be possible that the metallic plate is made to be on floating and insulated condition, thereby, toner adhesion is prevented and disturbance of toner image is prevented. Further, it may also be possible that voltage with the same polarity as that of toner (in the present example, negative polarity) is applied on the metallic plate so that toner adhesion is prevented, and thereby, disturbance of the toner image is prevented. When an insulating member such as an insulating resin member, or the like, is used for the spur 162, toner adhesion by the electric charge accumulation or mirror image force is prevented by charging, in the same manner as in the case of floating, and thereby, disturbance of the toner image can also be prevented.

The guide surface 163*a* of the conveyance guide member 163 is provided on the transfer material conveyance surface side (upper surface) rather than at the rotation center of the spur 162. Due to this, even when the leading edge portion of the recording sheet p separated from the toner image receiving body 14*a* comes into contact with the guide surface 163*a*, it is taken up by the guide surface 163*a* and sent to the spur 162, the spur 162 is rotated under the condition that a protruded portion 162*b* of the spur 162 comes into contact with the recording sheet P or sticks into it, and the recording sheet P on which the toner image is not rubbed, is conveyed to the fixing device 17.

Figure 14:
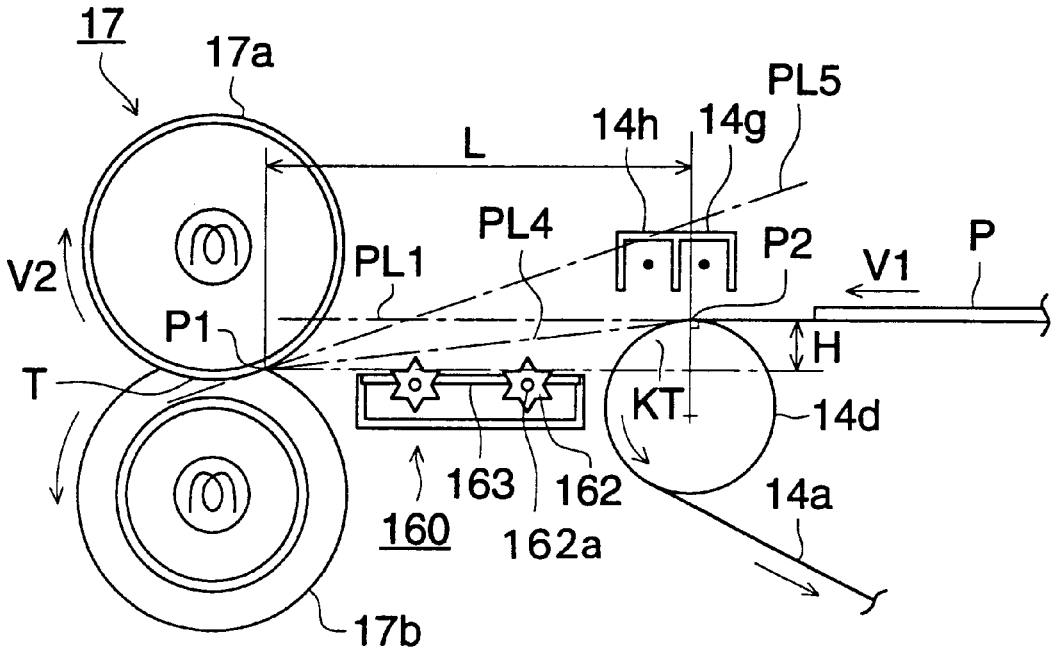
FIG. 14 is a view showing a positional relationship of a nip portion, a curvature portion of the second image carrier means, and the spur member.

As shown in FIG. 14, the recording sheet P on both sides of which the color toner image is formed, is separated from the toner image receiving body 14*a* by the curvature of a curvature portion KT of the toner image receiving body 14*a* trained around the driving roller 14*d*, and by the discharging operation of the paper separation AC discharger 14*h* as the transfer material separation means provided opposite to the driving roller 14*d* at need at the end portion of the toner image receiving body 14*a*.

The recording sheet P is conveyed by the spur 162 provided on the reverse surface side (lower side) lower than the transfer material conveyance surface PL1 of the toner image receiving body 14*a*, and is sent to the nip portion T of the fixing device 17 as the fixing means composed of the upper and lower rollers in which the hard roller is used as the fixing roller 17*a*, and the soft roller is used as the pressure contact roller 17*b*. A point P1 at the entry of the nip portion T is provided on the reverse surface side of the recording sheet P lower than the transfer material conveyance surface PL1 of the toner image receiving body 14*a*.

For the driving roller 14*d* as the roller member, around which the toner image receiving body 14*a* is trained, and which drives the toner image receiving body 14*a*, generally, as the outer diameter of the driving roller 14*d*, a roller having approximately 10–30 mm outer diameter is used and the curvature portion KT is formed. Further, the outer diameter of the upper and lower rollers of the fixing device 17 is approximately 30–60 mm. The distance L in the parallel direction with respect to the transfer material conveyance surface PL1 between the point P1 at the entry of the nip portion T and a separation position P2 at which the curvature portion KT of the toner image receiving body 14*a* begins to have curvature, is generally about 50–200 mm.

In the above description, a conveyance speed V2 of the recording sheet P by the fixing device 17 is set to be lower than a conveyance speed V1 of the recording sheet P by the toner image receiving body 14*a*, and the conveyance speed V2 is, with respect to the conveyance speed V1, $0.002\times V2 \leqq V1-V2 \leqq 0.05\times V2$. Due to this, a loop of the recording sheet P is formed between the point P1 at the entry of the nip portion T and a separation position P2 at which the curvature portion KT of the toner image receiving body 14*a* begins to have curvature. The loop of the recording sheet P is convex on the obverse surface side of the recording sheet P in the vicinity of the nip portion T by the nip portion T formed to be circular arc (convex-shape) on the reverse surface side of the recording sheet P, and is formed in the direction separated from the spur 162. When the velocity ratio is larger than 0.998, the loop of the recording sheet P is hardly formed, and the recording sheet is conveyed under the condition that the recording sheet P is pushed toward the spur 162, and sometimes disturbance (frictional damage) of the reverse side toner image occurs. Further, when the velocity ratio is not larger than 0.950, too large loop is formed, conveyance of the recording sheet P becomes unstable, the loop reaches the toner image receiving body 14*a*, and the recording sheet P is lifted from the toner image receiving body 14*a*, and thereby, sometimes a transfer trouble occurs at the reverse surface transfer device 14*g*.

Further, all of plural sets H1 and H2 of spurs 162 are arranged on the reverse surface side (lower side) of the recording sheet P, which is lower than the surface PL4 including the point P1 at the entry of the nip portion T of the fixing device 17 and a separation position P2 of the toner image receiving body 14*a*, at which the curvature portion KT of the toner image receiving body 14*a* begins to have curvature, and the separation position p2 is arranged on the reverse surface side (lower side) of the recording sheet P, which is lower than the tangent PL5 at the point P1 of the entry of the nip portion T. Thereby, the recording sheet P separated from the separation position P2 seldom receives the pressure from the spur 162 while it naturally drops by its self weight, and smoothly enters into the nip portion T; the number of contact of the recording sheet P with the spur 162 or contact time is decreased; the contact force of the recording sheet P with the spur 162 is greatly reduced, and the recording sheet P is conveyed from the toner image receiving body 14*a* to the fixing device 17, thereby, the stain of the toner image on the reverse side of the recording sheet by the spur 162 is prevented.

Further, as described above, when the entry of the nip portion T is provided on the reverse surface side of the recording sheet P lower than the transfer material conveyance surface PL1 of the toner image receiving body 14*a*, and the distance in the parallel direction between the point P1 at the entry of the nip portion T and the separation position P2 of the toner image receiving body 14*a* with respect to the transfer material conveyance surface PL1 is L and the distance between the point P1 and the point P2, perpendicular to the transfer material conveyance surface PL1, is H, then, the relationship $0.02 \leqq H/L \leqq 0.1$ is preferable. When $H/L \leqq 0.02$, the position of the spur 162 is higher with respect to the recording sheet P which is naturally dropped and conveyed, the pressing force to the reverse side toner image by the protruded portion 162*a* of the spur 162 is larger, and thereby, a stain (frictional damage) of the reverse side toner image frequently occurs. Further, when $H/L>0.1$, a fall of the recording sheet P after it is separated from the separation position P2, with respect to the spur 162 becomes larger, the conveyance of the recording sheet P by the spur is unstable, and thereby, entering of the recording sheet P into the nip portion T or gripping by the nip portion T is not conducted satisfactorily.

As described above, the spur 162 is used as an auxiliary means of the conveyance of the recording sheet P, a change of the conveyance track of the recording sheet P by the spur 162 is prevented, the recording sheet P is stably conveyed in the constant direction from the toner image receiving body 14*a* to the fixing device 17, and thereby, a stain of the reverse side toner image by the spur 162 of the recording sheet P conveyed from the toner image receiving body 14*a* to the fixing device 17 is prevented. In addition, disturbance of toner and transfer deviation on the reverse surface due to that recording paper P is pulled when recording paper P is sandwiched by fixing device 17 can be prevented.

The Sixth Example of Loop Formation of the Transfer Material

Figure 16:
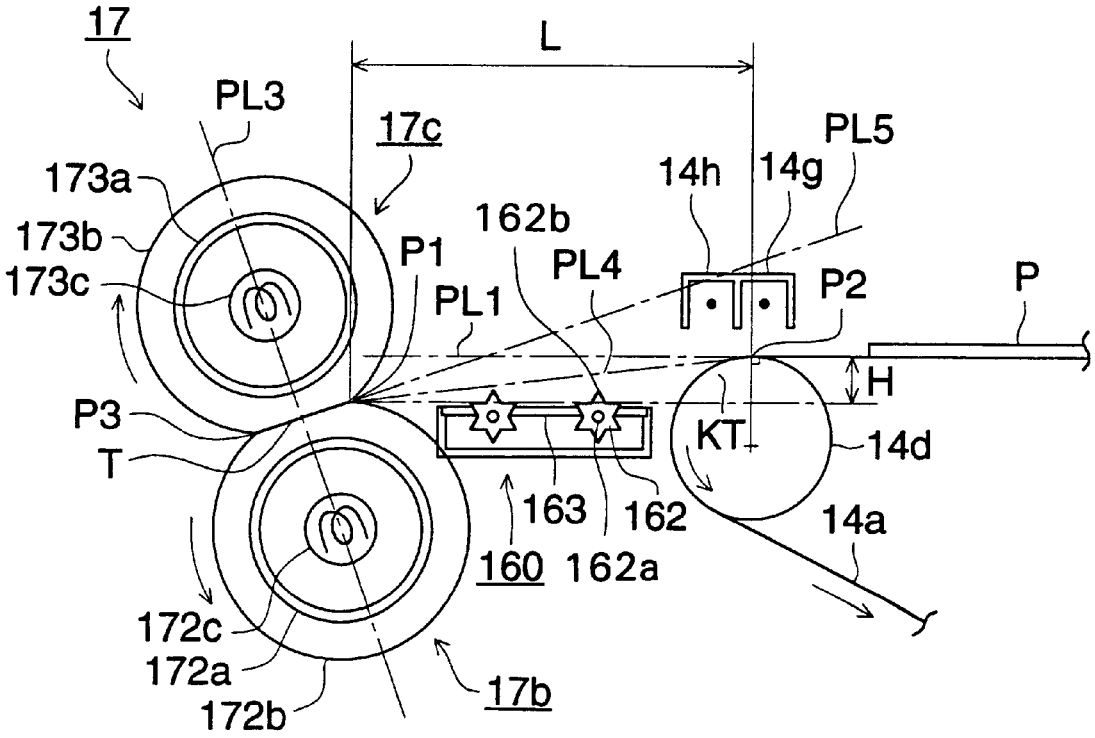
FIG. 16 is a view showing the roller structure used in the fixing means and the second example of the shape of its nip portion.

According to FIG. 16, as the roller members of the fixing device 17 of the present example, a fixing roller 17*c* using the soft roller is used as the upper roller, instead of the upper fixing roller 17*a* using the hard roller described in FIG. 14.

As respective roller members of the fixing device 17, a soft roller in which a rubber roller 173*b* using, for example, silicon member is formed around a metallic pipe 173*a* using, for example, aluminum member, and for example, Teflon coating is conducted on the surface, is used for the fixing roller 17*c* as the upper roller member, and, in the same manner as the upper fixing roller member, a soft roller in which a rubber roller 172*b* using, for example, silicon member is formed around a metallic pipe 172*a* using, for example, aluminum member, and for example, Teflon coating is conducted on the surface, is also used for the pressure contact roller 17*b* as the lower fixing roller member. When both rollers are in pressure-contact with each other, a nip portion T is formed between the upper and lower rollers respectively using the soft roller. Because the upper and lower rollers are composed of soft rollers, the nip portion T is linearly provided almost perpendicular to the surface PL3 passing the central axis of the fixing roller 17*c* and that of the pressure contact roller 17*b*. Halogen heaters 173*c* and 172*c* for a fixing heat are provided inside respective roller members.

The nip portion T is formed linearly, the surface PL3 is provided such that the upper roller is inclined toward the delivery side of the recording sheet P with respect to the transfer material conveyance surface PL1 of the toner image receiving body 14*a* as the second image carrier means, and the line formed between the point P1 at the entry and the point P3 at the exit of the nip portion T formed by the fixing roller 17*c* and the pressure contact roller 17*b* is provided with inclination toward the reverse surface side with respect to the conveyance direction of the recording sheet P.

The recording sheet P on both sides of which the color toner image is formed, is separated from the toner image receiving body 14*a* by the curvature of a curvature portion KT of the toner image receiving body 14*a* trained around the driving roller 14*d*, and by the discharging operation of the paper separation AC discharger 14*h* as the transfer material separation means provided opposite to the driving roller 14*d* at need at the end portion of the toner image receiving body 14*a*. The recording sheet P is conveyed by the spur 162 provided on the reverse surface side (lower side) lower than the transfer material conveyance surface PL1 of the toner image receiving body 14*a*, and is sent to the nip portion T of the fixing device 17 as the fixing means composed of the upper and lower rollers in which the soft roller is used as the fixing roller 17*c*, and the soft roller is used as the pressure contact roller 17*b*.

Figure 15:
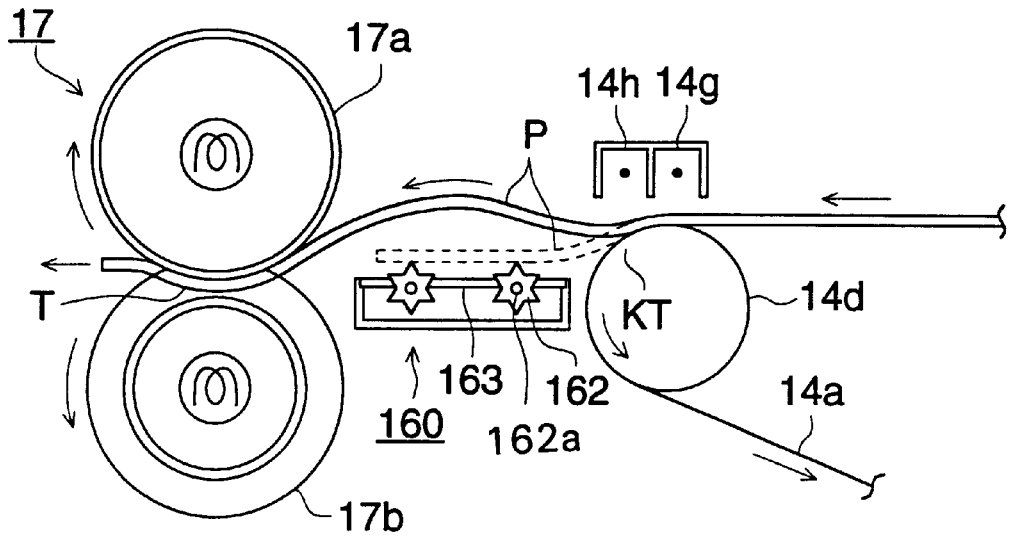
FIG. 15 is a view showing a looping shape of the transfer material formed by the second image carrier means and the fixing means.

The loop of the recording sheet P is formed by the nip portion T provided with inclination, in the same manner as described in FIG. 15. The loop is convex on the obverse surface side of the recording sheet P in the vicinity of the nip portion T, and is formed in the direction separated from the spur 162. The positional relationship of the nip portion T of the fixing device 17, the curvature section KT of the toner image receiving body 14*a*, and the spur 162 is structured in the same manner as described in FIG. 14. Thereby, while the recording sheet P separated from the separation position P2 naturally drops by self weight, the recording sheet P seldom receives the pressure from the spur 162 t, and smoothly enters into the nip portion T; the number of contact of the recording sheet P with the spur 162 or contact time is decreased; the contact force of the recording sheet P with the spur 162 is greatly reduced, and the recording sheet P is conveyed from the toner image receiving body 14*a* to the fixing device 17, thereby, the stain of the toner image on the reverse side of the recording sheet by the spur 162 is prevented.

Further, the spur 162 is used as an auxiliary means of the conveyance of the recording sheet P, a change of the conveyance track of the recording sheet P by the spur 162 is prevented, the recording sheet P is stably conveyed in the predetermined direction from the toner image receiving body 14*a* to the fixing device 17, and thereby, a stain of the reverse side toner image by the spur 162 of the recording sheet P conveyed from the toner image receiving body 14*a* to the fixing device 17 is prevented.

The Seventh Example of the Loop Formation of the Transfer Sheet

Figure 17:
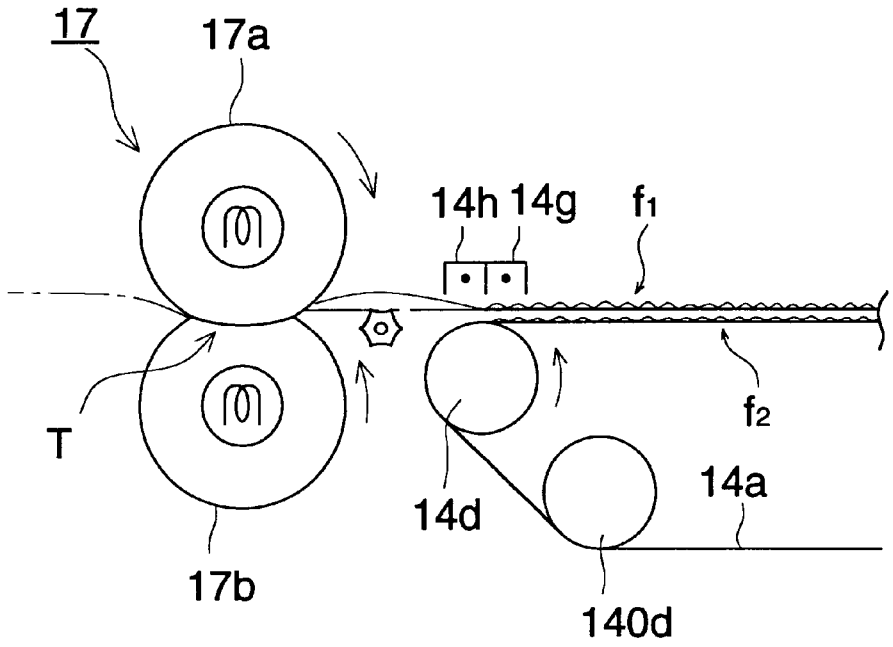
FIGS. 17 and 18 are illustrations showing the posture of conveyance of the transfer material with respect to the fixing means.
Figure 18:
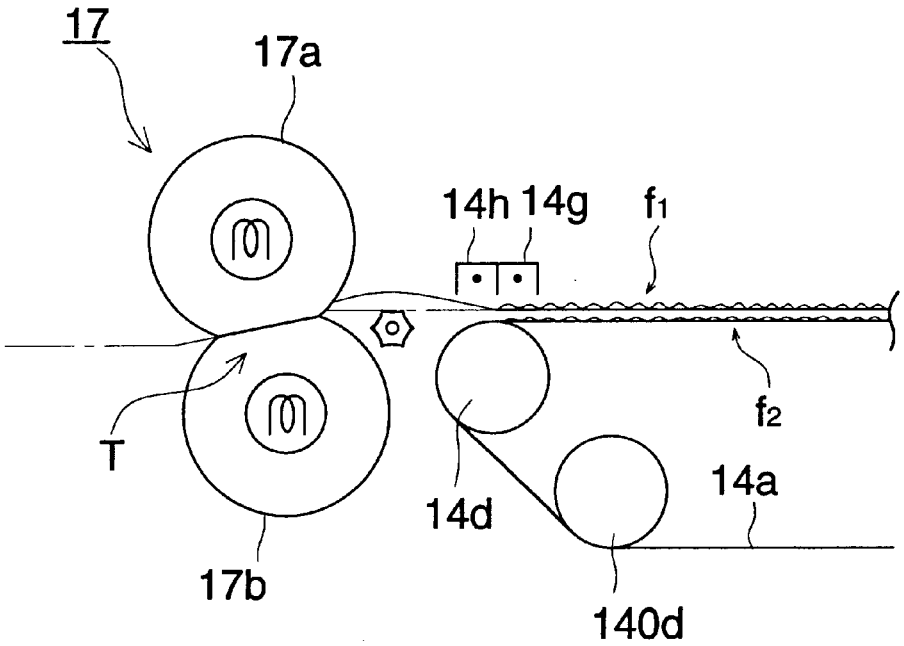

Referring to FIGS. 17 and 18, the present example will be described below.

The conveyance speed of the transfer material by the fixing means in the image forming apparatus of the present example, that is, the peripheral speed $V_2$ of the nip portion T formed by the roller 17*a* (fixing roller 17*a*) and the roller 17*b* (fixing roller 17*b*) is set to the slightly lower speed than the conveyance speed of the transfer material by the second image carrier means, that is, the peripheral speed $V_1$ of the toner image receiving body 14*a*. Accordingly, the recording sheet P as the transfer material produces some slacks between a position where recording paper P is separated from toner image receiving body 14*a* and the nip portion T formed by the roller 17*a*, after the leading edge portion of the recording sheet P has been nipped in the nip portion T, and is conveyed while forming a loop.

The nip portion T of the fixing means is formed to be convex with respect to the reverse surface side of the transfer material, that is, the roller 17*b* side as shown in FIG. 17, or the inclination of the entry and the exit of the nip portion T is formed into a plane inclined on the reverse surface side with respect to the conveyance direction of the transfer material as shown in FIG. 18. After the leading edge of the recording sheet P separated from the peripheral surface of the toner image receiving body 14*a* comes into contact with the peripheral surface of the roller 17*a*, the recording sheet P is conveyed to the nip portion T along the peripheral surface, nipped and heated, and the toner images transferred onto both of obverse side and reverse side are simultaneously fixed by the fixing device 17.

As the result, after the transfer of the toner image, the recording sheet P is almost linearly conveyed as shown by a one-dotted chain line in the initial stage of separation from the toner image receiving body 14*a* and comes into contact with the peripheral surface of the fixing roller 17*a*, and in the late stage of separation after the leading edge of the recording sheet P is nipped by the nip portion T, the recording sheet P is conveyed while forming the convex loop on the side surface side, by the force according to the shape of the nip portion T, as shown by a two-dotted chain line. When a variation range of the posture of conveyance satisfies the conveyance condition, which will be described later, it is limited, and thereby, the conveyed recording sheet P is stably conveyed, delivered without disturbing the transferred toner image, and is fixed.

In the delivery of the recording sheet P to the fixing device 17, when an amount of the slack of the recording sheet P by the loop formation is not larger than 5% of the minimum conveyance distance by which the conveyance between a position where recording paper P is separated from toner image receiving body 14*a* and the nip portion can be conducted, the recording sheet can be conveyed without any trouble. When the amount of slack is not smaller than 5% and the recording sheet is loosened, the toner image on the obverse side of the recording sheet is rubbed by the paper separation AC discharger 14*h* and the obverse image is disturbed, or the recording sheet P is bent at the entry of the nip portion of the fixing device and jamming easily occurs. The above description is confirmed by experiments by inventors of the present invention. Accordingly, the difference between the conveyance speed $V_1$ by the toner image receiving body 14*a* and the conveyance speed $V_2$ by the rollers 17*a* and 17*b* is set as follows.

When the maximum length of the recording sheet P used in the present image forming apparatus is $L_1$, the minimum conveyance distance by which the conveyance between a position where recording paper P is separated from toner image receiving body 14*a* and the nip portion T can be carried out is $L_2$, the slack amount of the recording sheet P after time t has passed after the leading edge of the recording sheet P has been nipped in the nip portion T is $X_1$, and the moving distance of the recording sheet P after time t has passed is $X_2$, $$t=X_2/V_2 \quad (1)$$

$$X_1=(V_1-V_2)t \quad (2)$$

By equations (1) and (2), the difference between the conveyance speed is $$V_1-V_2=(x_1/X_2)\times V_2 \quad (3)$$

As the conditional relationship obtained by the previous experiments, $$X_1 \leqq L_2\times 0.05$$

The maximum moving distance of the recording sheet P on the nip surface at the time is $$X_{2max}=L_1-L_2$$

Accordingly, by the equation (3), $V_1$ and $V_2$ may be set so as to satisfy the following equation, $$V_1-V_2 \leqq \{(L_2\times 0.05)/(L_1-L_2)\}\times V_2 \quad (4)$$

Further, the relationship (4) is given a margin, $$V_1-V_2 \leqq \{(L_2\times 0.05)/L_1\}\times V_2 \quad (5)$$

Further, in order to stably form an adequate amount of loop on the conveyance path, the difference between $V_1$ and $V_2$ is preferably more than 1% of $V_2$, for the safety's sake, and it is the preferable condition that the difference satisfies the following conditional relationship (6) together with the relationship (5).

$$0.01\times V_2 \leqq V_1-V_2 \leqq \{(L_2\times 0.05)/L_1\}\times V_2 \quad (6)$$

Incidentally, in FIGS. 17 and 18, driven roller 140*d* is provided so as to support the toner image receiving body 14*a*.

Example of a Conveyance Section Having No Spur Wheel

In the above-mentioned embodiment, a conveyance section having a spur was explained. However, the present invention is not limited thereto. In conveyance section 160 explained in FIGS. 5 and 6, spur 162 is not provided. In addition, in place of conveyance guide member 163, a conveyance guide wire whose diameter was 50–150 μm was extended at the same position as guide surface 163*a* of the above-mentioned conveyance guide member. This can be used as a conveyance guide member.

The conveyance section having a conveyance guide wire is provided on the reverse surface of the transfer material from the extended surface of the transfer material conveyance surface of toner image receiving body 14*a* between toner image receiving body 14*a* and fixing device 17. The conveyance guide wire is extended parallel to the direction of the conveyance of transfer material or extending with an opening angle of 5–20°. Distance between a position where toner image receiving body 14*a* start having curvature at the end of fixing device 17 and the inlet portion of the nip portion of fixing device 17 is ordinarily set to be 50–200 mm at a conveyance section having a spur.

The end of recording paper P separated from toner image receiving body 14*a* is temporarily brought into contact with a conveyance guide wire. Following it, it is separated from the conveyance guide wire due to stiffness of recording paper P. While it is separated from the conveyance guide wire, it advances to the nip portion of fixing device 17.

When the end of recording paper P is sandwiched at the nip portion, a loop is formed in such a manner that recording paper P is additionally separated from the conveyance guide wire due to the form of the nip portion or the inclination of the nip surface. Recording paper P is conveyed to fixing device 17 while not being contacted to the conveyance guide wire.

Due to the above, the occurrence of toner contamination of the transfer material due to scrubbing of the toner image on the transfer material due to the conveyance guide wire or contamination of the conveyance guide wire.

Examples of Cleaning for the Spur

Figure 19:
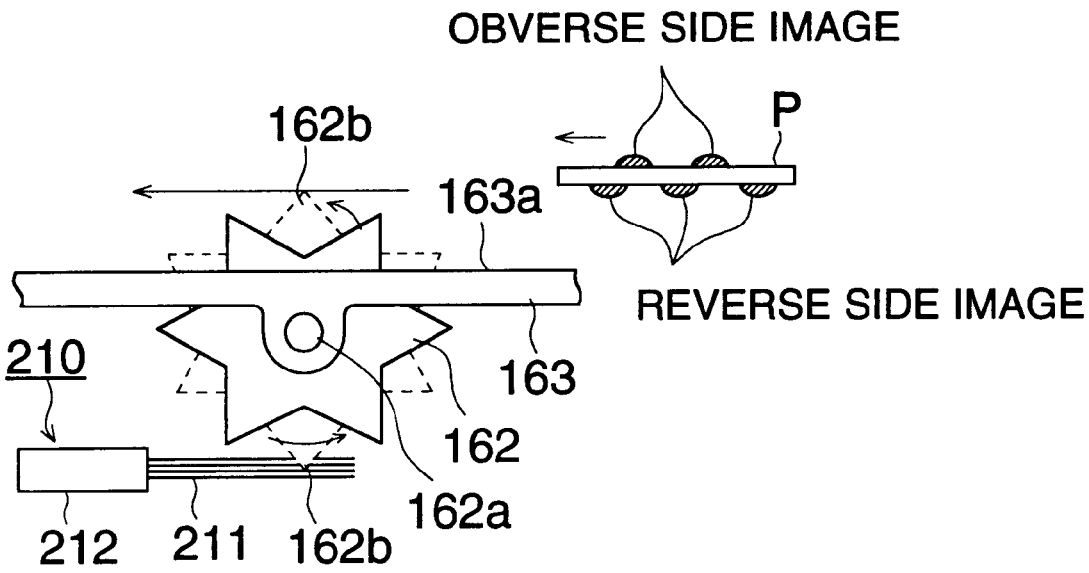
FIG. 19 is a view showing the first example of a fitting method of a cleaning member to the spur.
Figure 20:
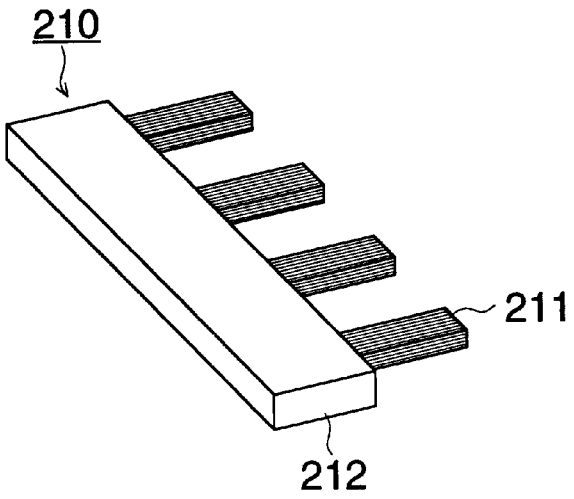
FIG. 20 is a perspective view showing a cleaning member.
Figure 21:
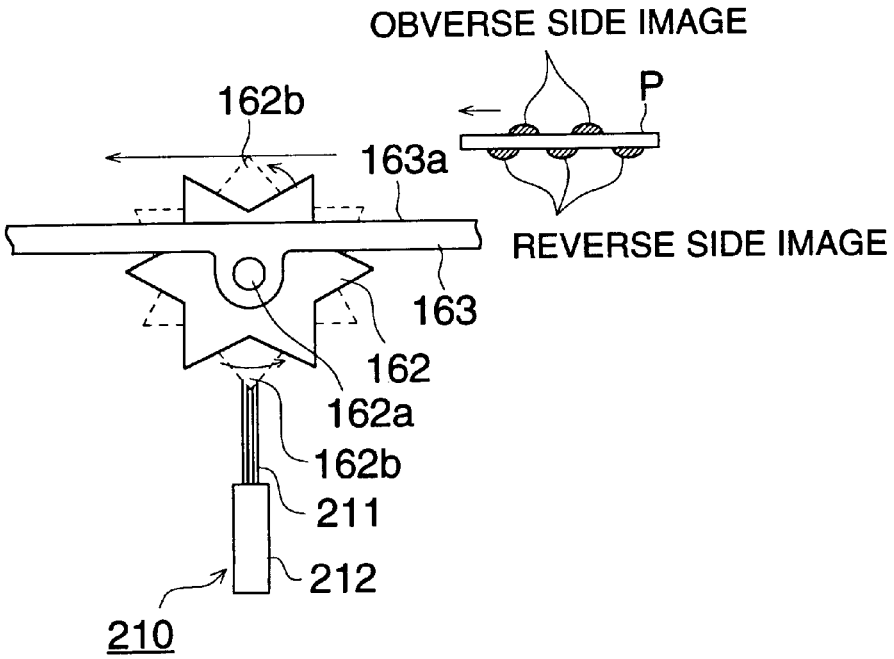
FIG. 21 is a view showing the second example of a fitting method of the cleaning member to the spur.
Figure 22:
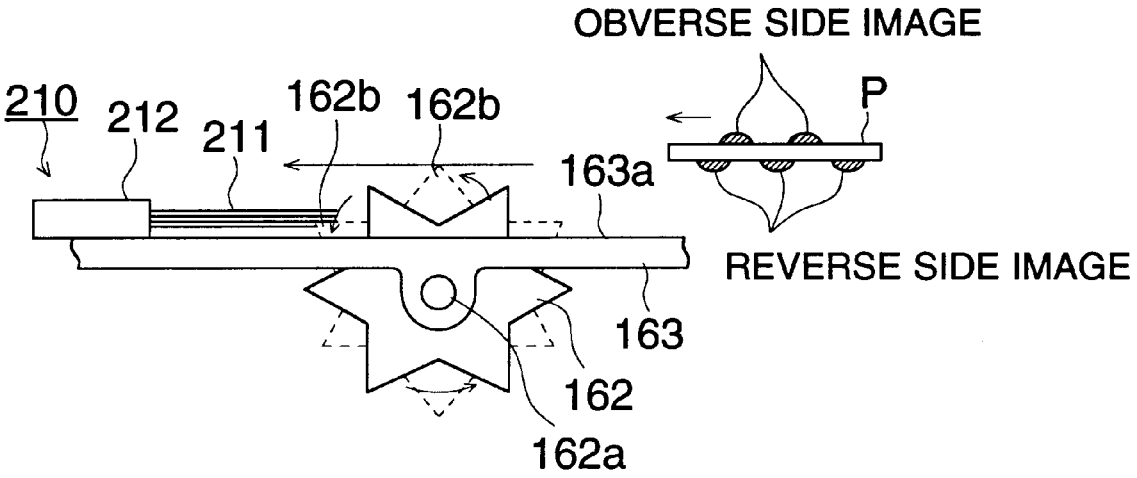
FIG. 22 a view showing the third example of a fitting method of the cleaning member to the spur.

Referring to FIGS. 19 to 22, a cleaning member for the spur and its arrangement will be described below. FIG. 19 is a view showing the first example of a fitting method of the cleaning member for the spur. FIG. 20 is a perspective view showing the cleaning member. FIG. 21 is a view showing the second example of the fitting method of the cleaning member for the spur. FIG. 22 is a view showing the third example of the fitting method of the cleaning member for the spur.

As described in FIGS. 5 and 6, the conveyance section 160 having the spur is provided between the toner image receiving body 14*a* as the second image carrier means and the fixing device 17 as the fixing means.

The recording sheet P on both sides of which the color toner image is formed, is separated from the toner image receiving body 14*a* by the curvature of the driving roller 14*d* to drive the toner image receiving body 14*a*, and by the discharging operation of the paper separation AC discharger 14*h* as the transfer material separation means provided opposite to the driving roller 14*d* at need at the end portion of the toner image receiving body 14*a*.

The recording sheet P separated from the toner image receiving body 14*a* as the second image carrier means, is conveyed by the spur 162 provided in the conveyance section 160, and is sent to the nip portion T of the fixing device 17 as the fixing means composed of the fixing roller 17*c* and the pressure contact roller 17*b*, and toner images on both sides of the recording sheet P are fixed.

As shown in FIGS. 19 and 20, the central shaft 162*a* integrated with the spur 162 is fitted to the conveyance guide member 163, and the spur 162 is rotatable with respect to the conveyance guide member 163. The recording sheet P on which the toner image is formed, is conveyed on the spur 162. The protruded portion 162*b* of the spur 162 driven by the recording sheet P is stained by the reverse side toner image, and a stain by the image is generated on the conveyed recording sheet P by the toner adhered onto the protruded portion 162*b*. Therefore, a cleaning member 210 is provided so that toner adhered onto the protruded portion 162*b* is cleaned. Further, the guide surface 163*a* of the conveyance guide member 163 is provided on the side of passage of the recording sheet P rather than the center of the spur 162, so that taking up of the leading edge of the recording sheet P after separation of the recording sheet P from the toner image receiving body 14*a*, described in FIG. 5, is conducted. Thereby, the frictional damage of the toner image due to falling of the leading edge portion of the recording sheet P at the time of entrance of the transfer material into the conveyance section, or due to falling of the trailing edge at the time of passing through the conveyance section, can be prevented.

As shown in FIG. 20, the cleaning member 210 is composed of a cleaning brush 211 and a brush holder 212 to hold the cleaning brush 211. In FIG. 20, the cleaning brush 211 is provided in a position opposite to the spur 162, however, the brush section may be continuously provided.

By using the brush member as the cleaning member, the rotation of the spur is finely maintained, and the spur is satisfactorily cleaned.

As shown in FIG. 19, the cleaning member 210 is arranged such that a leading edge of the cleaning brush 211 is on the downstream side of the rotational direction of the spur 162 on the opposite side of the passage side of the recording sheet P, and the leading edge portion of the cleaning brush 211 is in contact with the protruded portion 162*b*. When whiskers of the cleaning brush 211 are parallelly arranged, the rotation of the spur 162 is not disturbed and the toner adhered to the protruded portion 162*b* is cleaned. In order to finely clean the adhered toner, a coarse-whiskered brush is preferable. Further, when the protruded portion 162*b* comes into deep-contact with the brush of the cleaning brush 211, the spur 162 is faultily rotated, therefore, it is preferable that the protruded portion 162*b* is in shallow-contact with the brush, for example, with about 0.5–1.5 mm depth of the leading edge portion.

Due to the above description, the cleaning member is arranged so that the conveyance of the transfer material is not disturbed.

Further, as shown in FIG. 21, the following may also be possible: the cleaning member 210 is arranged in such a manner that the cleaning member 210 is almost vertically provided on the lower side of the rotating section of the spur 162 on the opposite side of the passage side of the recording sheet P, and the leading edge portion of the cleaning brush 211 comes into contact with the protruded portion 162*b*, so that the toner adhered to the protruded portion 162*b* is cleaned. In this case, the protruded portion 162*b* can more deeply be in contact with the brush, rather than in the case where the cleaning brush 211 is horizontally provided. However, when the protruded portion 162*b* is in deep-contact with the brush of the cleaning brush 211, the spur is faultily rotated, therefore, it is preferable that about 1.0–2.0 mm depth of the leading edge portion is in contact with the brush.

Owing to the above description, the cleaning member is arranged such that the conveyance of the transfer material is not disturbed.

Further, as shown in FIG. 22, the following is also possible: the cleaning member 210 is arranged on the guide surface 163*a* of the conveyance guide member 162 on the passage side of the recording sheet P, and the leading edge of the cleaning brush 211 of the cleaning member 210 is in contact with the protruded portion 162*b* of the spur 162, thereby, the toner adhered to the protruded portion 162*b* is cleaned. The brush surface of the cleaning brush 211 may also be arranged on the same surface as the guide surface 163*a*. In FIG. 24, the cleaning member 210 is arranged on the downstream side of the rotational direction of the spur 162 with respect to the contact position with the recording sheet P, however, it may also be allowable that the cleaning member 210 is arranged on the guide surface 163*a* of the conveyance guide member 163, or on the same surface as the guide surface 163*a* on the upstream side, so that the leading edge of the brush of the cleaning brush 211 is in contact with the protruded portion 162*b*.

Owing to the description in FIGS. 19 to 22 a position where recording paper P is separated from toner image receiving body 14*a*, the spur is finely cleaned and the spur is prevented from staining.

Further, as the example of the two-sided image forming apparatus, the color image forming apparatus is described, however, the present invention is not necessarily limited to that, but it can also be applied for a monochromatic two-sided image forming apparatus in the same process as that described in FIG. 1.

Further, in the image forming apparatus of the present invention, other than the two-sided image formation by which the images are formed on both sides of the transfer material as described in examples, of course, the single-side image formation by which the image is formed on the single side, that is, only on the obverse side or reverse side of the transfer material, can be conducted.

As described above, according to the present invention, generation of the spur track onto the toner image on the transfer material and toner contamination of a transfer material due to contamination of spur are prevented, and a frictional damage of the image when the transfer material is nipped in the fixing means is prevented.

The spur is finely cleaned, and the spur is prevented from staining.

The rotation of the spur is finely maintained, and the spur is finely cleaned.

The frictional damage of the toner image caused by falling of the leading edge portion at the time of entry of the transfer material into the conveyance section, and by falling of the trailing edge at the time of passage of the trailing edge through the conveyance section, is prevented.

The cleaning member is arranged so that conveyance of the transfer material is not prevented.

According to the present invention, the transfer material has no pulling force which lowers the image quality, and has an adequate slack stably, in the conveyance process of the transfer material to the fixing means from second image carrier means, thereby, there is no possibility to disturb the toner image, and the transfer sheet is successively conveyed to the transfer area and, next, to the fixing area.

When the transfer material is delivered to each area, the toner image is prevented from being disturbed, and the safety and reliability are assured. The excessive slack of the transfer material is prevented, and generation of conveyance failure such as jamming is prevented.

As the result, an image forming apparatus is provided in which the conveyance characteristics of the transfer material, on both sides of which toner images are held, are stable and satisfactory, and the formed image is not deteriorated and can be recorded with the high quality.

What is claimed is:

1. An apparatus for forming an image, comprising:

a first image carrying member;

toner image forming means for forming reverse side and obverse side toner images on the first image carrying member;

a belt-shaped second image carrying member onto which the reverse side toner image is transferred;

a first transfer member for transferring the obverse side toner image from the first image carrying member to a first side of a sheet;

a second transfer member for transferring the reverse side toner image from the belt-shaped second image carrying member to a second side of the sheet;

a fixing device for simultaneously fixing the toner images transferred onto the first and second sides of the sheet, the fixing device forming a nip region between a pair of rotatable fixing members and fixing the toner images onto the sheet by nipping and conveying the sheet through the nip region; and a conveyance section comprising a spur wheel, provided between the belt-shaped second image carrying member and the fixing device, for conveying a leading edge portion of the sheet separated from an end of the belt-shaped second image carrying member to the fixing device, wherein the belt-shaped second image carrying member is arranged to form a sheet conveying plane on which the sheet is conveyed toward the fixing device;

wherein the belt-shaped second image carrying member and the fixing device are arranged such that when the sheet is nipped and conveyed through the nip region, the sheet is conveyed so as to form a loop protruding above a connecting line that connects an entrance to the nip region and an end of the sheet conveying plane of the belt-shaped second image carrying member, and wherein a top of the spur wheel of the conveyance section is located beneath the connecting line.

2. The apparatus of claim 1, wherein the loop is protruded from a plane extended from the sheet conveying plane of the belt-shaped second image carrying member.

3. The apparatus of claim 1, wherein the loop is protruded from an extended plane of the sheet conveying plane of the belt-shaped second image carrying member toward an opposite side of the conveyance section.

4. The apparatus of claim 1, wherein the conveyance section comprises a linear guide member extended in a direction of sheet conveyance.

5. The apparatus of claim 1, wherein the conveyance section and the belt-shaped second image carrying member are located at a same side of a plane extended from the sheet conveying plane of the belt-shaped second image carrying member.

6. The apparatus of claim 1, wherein the sheet forms the loop in accordance with a shape of the nip region of the fixing device and the belt-shaped second image carrying member.

7. The apparatus of claim 6, wherein the nip region is shaped to protrude from a line connecting the entrance to and an exit from the nip region toward a same side of the conveyance section.

8. The apparatus of claim 7, wherein a first one of the pair of rotatable fixing members comprises a soft roller and a second one of the pair of rotatable fixing members comprises a hard roller.

9. The apparatus of claim 7, wherein the nip region of the fixing device is shaped to protrude toward the second side of the sheet.

10. The apparatus of claim 7 wherein the pair of rotatable fixing members and the belt-shaped second image carrying member are arranged such that a first one of the pair of rotatable fixing members contacts the first side of the sheet and a plane extended from the sheet conveying plane of the belt-shaped second image carrying member collides with the first one of the pair of rotatable fixing members.

11. The apparatus of claim 8, wherein the soft roller is arranged to be brought into pressure contact with the hard roller so that the soft roller is deformed to form the nip region.

12. The apparatus of claim 1, wherein a first one of the pair of rotatable fixing members is arranged to contact the first side of the sheet and a plane extended from the sheet conveying plane of the belt-shaped second image carrying member intersects with the first one of the pair of rotatable fixing members.

13. The apparatus of claim 1, wherein a first one of the pair of rotatable fixing members is arranged to contact the first side of the sheet and a second guide member is provided between the conveyance section and the fixing device and causes the sheet to collide with the first one of a pair of rotatable fixing members.

14. An apparatus for forming an image, comprising:

a first image carrying member;

toner image forming means for forming reverse side and obverse side toner images on the first image carrying member;

a belt-shaped second image carrying member onto which the reverse side toner image is transferred;

a first transfer member for transferring the obverse side toner image from the first image carrying member to a first side of a sheet;

a second transfer member for transferring the reverse side toner image from the belt-shaped second image carrying member to a second side of the sheet;

a fixing device for simultaneously fixing the toner images transferred onto the first and second sides of the sheet, the fixing device forming a nip region between a pair of rotatable fixing members and fixing the toner images onto the sheet by nipping and conveying the sheet through the nip region; and a conveyance section, provided between the belt-shaped second image carrying member and the fixing device, for guiding the sheet separated from an end of the belt-shaped second image carrying member to the fixing device, wherein the belt-shaped second image carrying member is arranged to form a sheet conveying plane on which the sheet is conveyed toward the fixing device;

wherein the belt-shaped second image carrying member and the fixing device are arranged such that when the sheet is nipped and conveyed through the nip region, the sheet is conveyed so as to form a loop protruding from a connecting line that connects an entrance to the nip region and an end of the sheet conveying plane of the belt-shaped second image carrying member, wherein the sheet forms the loop in accordance with a shape of the nip region and the belt-shaped second image carrying member, and wherein the pair of rotatable fixing members are arranged such that a line connecting the entrance to and an exit from the nip region is inclined relative to a plane extended from the sheet conveying plane of the belt-shaped second image carrying member.

15. The apparatus of claim 14, wherein the pair of rotatable fixing members are soft rollers.

16. The apparatus of claim 14, wherein the belt-shaped second image carrying member and the conveyance section are located at a same side of the line connecting the entrance to and the exit from the nip region.

17. An apparatus for forming an image, comprising:

a first image carrying member;

toner image forming means for forming reverse side and obverse side toner images on the first image carrying member;

a belt-shaped second image carrying member onto which the reverse side toner image is transferred;

a first transfer member for transferring the obverse side toner image from the first image carrying member to a first side of a sheet;

a second transfer member for transferring the reverse side toner image from the belt-shaped second image carrying member to a second side of the sheet;

a fixing device for simultaneously fixing the toner images transferred onto the first and second sides of the sheet, the fixing device forming a nip region between a pair of rotatable fixing members and fixing the toner images onto the sheet by nipping and conveying the sheet through the nip region; and a conveyance section, provided between the belt-shaped second image carrying member and the fixing device, for guiding the sheet separated from an end of the belt-shaped second image carrying member to the fixing device, wherein the belt-shaped second image carrying member is arranged to form a sheet conveying plane on which the sheet is conveyed toward the fixing device;

wherein the belt-shaped second image carrying member and the fixing device are arranged such that when the sheet is nipped and conveyed through the nip region, the sheet is conveyed so as to form a loop protruding from a connecting line that connects an entrance to the nip region and an end of the sheet conveying plane of the belt-shaped second image carrying member, and wherein a sheet conveying speed of the fixing device is set to be slower than a sheet conveying speed of the belt-shaped second image carrying member.

18. The apparatus of claim 17, wherein the loop is maintained by a difference in the conveying speed between the fixing device and the belt-shaped second image carrying member.

19. The apparatus of claim 17, wherein the nip region is shaped to protrude from a line connecting the entrance to and an exit from the nip region toward a same side of the conveyance section.

20. The apparatus of claim 17, wherein the pair of rotatable fixing members are arranged such that a line connecting the entrance to and an exit from the nip region is inclined relative to a plane extended from the sheet conveying plane of the belt-shaped second image carrying member.

21. The apparatus of claim 20, wherein the belt-shaped second image carrying member and the conveyance section are located at a same side of the line connecting the entrance to and the exit from the nip region.

22. The apparatus of claim 17, wherein the sheet conveying speed of the fixing device and the sheet conveying speed of the belt-shaped second image carrying member are controlled such that a maximum height of the loop is kept lower than a predetermined height.

23. The apparatus of claim 22, wherein the sheet conveying speed $V_2$ (mm/sec.) of the fixing device and the sheet conveying speed $V_1$ (mm/sec.) of the belt-shaped second image carrying member satisfy the following formula, $$0.01\times V_2 \leqq V_1 - V_2 \leqq (L_2\times 0.05/L_1)\times V_2$$

wherein a maximum length of the sheet in a direction of sheet conveyance is $L_1$ (mm) and a shortest distance between a separating position at which the sheet is separated from the belt-shaped second image carrying member and an entrance to the nip region of the fixing device is $L_2$ (mm).

24. An apparatus for forming an image, comprising:

a first image carrying member;

toner image forming means for forming reverse side and obverse side toner images on the first image carrying member;

a belt-shaped second image carrying member onto which the reverse side toner image is transferred;

a first transfer member for transferring the obverse side toner image from the first image carrying member to a first side of a sheet;

a second transfer member for transferring the reverse side toner image from the belt-shaped second image carrying member to a second side of the sheet;

a fixing device for simultaneously fixing the toner images transferred onto the first and second sides of the sheet, the fixing device forming a nip region between a pair of rotatable fixing members and fixing the toner images onto the sheet by nipping and conveying the sheet through the nip region;

a separating section, provided at a fixing device-side end of the belt-shaped second image carrying member, for separating the sheet from the belt-shaped second image carrying member; and a conveyance section, provided between the belt-shaped second image carrying member and the fixing device, for guiding the sheet separated from the belt-shaped second image carrying member to the fixing device, wherein the belt-shaped second image carrying member is arranged to form a sheet conveying plane on which the sheet is conveyed toward the fixing device;

wherein the belt-shaped second image carrying member and the fixing device are arranged such that when the sheet is nipped and conveyed through the nip region, the sheet is conveyed so as to form a loop protruding from a connecting line that connects an entrance to the nip region and an end of the sheet conveying plane of the belt-shaped second image carrying member, and wherein the fixing device, the conveyance section and the belt-shaped second image carrying member are arranged such that the conveyance section and the separating section are located at a same side of a plane extended from an entrance to the nip region, and wherein the nip region is shaped to protrude from a line connecting the entrance to and an exit from the nip region toward a same side of the conveyance section.

25. The apparatus of claim 24, wherein a roller member to support the belt-shaped second image carrying member is provided at the separating section to form a curved portion so that the sheet is separated by a curvature of the curved portion.

26. The apparatus of claim 24, wherein a sheet conveying speed of the fixing device is set to be slower than a sheet conveying speed of the belt-shaped second image carrying member.

27. The apparatus of claim 24, wherein the entrance to the nip region is located at a second side of the sheet from the sheet conveying plane of the belt-shaped second image carrying member, and wherein a distance L parallel to the sheet conveying plane between the entrance to the nip region and the separating section and a distance H perpendicular to the sheet conveying plane between the entrance to the nip region and the separating section satisfy the following formula:

$$0.02 \leqq H/L \leqq 0.1$$

28. An apparatus for forming an image, comprising:

a first image carrying member;

toner image forming means for forming reverse side and obverse side toner images on the first image carrying member;

a belt-shaped second image carrying member onto which the reverse side toner image is transferred;

a first transfer member for transferring the obverse side toner image from the first image carrying member to a first side of a sheet;

a second transfer member for transferring the reverse side toner image from the belt-shaped second image carrying member to a second side of the sheet;

a fixing device for simultaneously fixing the toner images transferred onto the first and second sides of the sheet, the fixing device forming a nip region between a pair of rotatable fixing members and fixing the toner images onto the sheet by nipping and conveying the sheet through the nip region; and a conveyance section, provided between the belt-shaped second image carrying member and the fixing device, for guiding the sheet separated from an end of the belt-shaped second image carrying member to the fixing device, wherein the belt-shaped second image carrying member is arranged to form a sheet conveying plane on which the sheet is conveyed toward the fixing device;

wherein the belt-shaped second image carrying member and the fixing device are arranged such that when the sheet is nipped and conveyed through the nip region, the sheet is conveyed so as to form a loop protruding from a connecting line that connects an entrance to the nip region and an end of the sheet conveying plane of the belt-shaped second image carrying member, and wherein the conveyance section comprises a rotatable spur sheet and a cleaning member arranged to contact a tip end of the spur wheel so as to clean the spur wheel.

29. The apparatus of claim 28, wherein the cleaning member comprises a brush member.

30. The apparatus of claim 28, wherein the conveyance section comprises a guide member extended in a direction of sheet conveyance, and the guide member is arranged between the conveyed sheet and a center of the spur wheel.

31. The apparatus of claim 30, wherein the cleaning member is located at a same side as the center of the spur wheel with respect to the guide member.

32. The apparatus of claim 30, wherein the cleaning member is located at an opposite side to the center of the spur wheel with respect to the guide member.

* * * * *